US011425933B2

(12) United States Patent
Tidwell et al.

(10) Patent No.: US 11,425,933 B2
(45) Date of Patent: Aug. 30, 2022

(54) CHILD-RESISTANT CASE AND RELATED METHODS

(71) Applicants: Justin Tidwell, Brea, CA (US); William Tidwell, Brea, CA (US)

(72) Inventors: Justin Tidwell, Brea, CA (US); William Tidwell, Brea, CA (US)

( * ) Notice: Subject to any disclaimer, the term of this patent is extended or adjusted under 35 U.S.C. 154(b) by 0 days.

(21) Appl. No.: 16/854,827

(22) Filed: Apr. 21, 2020

(65) Prior Publication Data

US 2021/0186092 A1 Jun. 24, 2021

Related U.S. Application Data

(63) Continuation-in-part of application No. 16/734,281, filed on Jan. 3, 2020, which is a continuation of application No. 29/717,611, filed on Dec. 18, 2019.

(51) Int. Cl.

| | |
|---|---|
| ***A24F 15/12*** | (2006.01) |
| ***B65D 85/10*** | (2006.01) |
| ***B65D 25/04*** | (2006.01) |
| ***B65D 43/16*** | (2006.01) |
| ***A24F 15/01*** | (2020.01) |
| ***B65D 43/22*** | (2006.01) |

(52) U.S. Cl.

CPC ..... *A24F 15/12* (2013.01); *A24F 15/01* (2020.01); *B65D 25/04* (2013.01); *B65D 43/16* (2013.01); *B65D 43/22* (2013.01); *B65D 85/10* (2013.01); *B65D 2215/02* (2013.01)

(58) Field of Classification Search

CPC ..... A45F 15/00; A45F 15/12; A45F 15/01; B65D 43/22; B65D 43/16; B65D 85/02; B65D 85/07; B65D 85/08; B65D 85/10; B65D 85/1009; B65D 85/122; B65D 85/30; B65D 83/00; B65D 83/02; B65D 85/12; B65D 85/20; B25H 3/003; A24F 15/00; A24F 15/12; A24F 15/01

See application file for complete search history.

(56) References Cited

U.S. PATENT DOCUMENTS

| | | | | |
|---|---|---|---|---|
| 10,414,553 | B2 * | 9/2019 | Ziering | B65D 25/04 |
| 2016/0050975 | A1 * | 2/2016 | Worm | A24F 40/40 131/328 |
| 2017/0043910 | A1 * | 2/2017 | Hopps | B65D 43/165 |
| 2017/0334605 | A1 * | 11/2017 | Murphy | B65D 85/20 |
| 2019/0289905 | A1 * | 9/2019 | Alarcon | A24F 15/01 |

* cited by examiner

*Primary Examiner* — Javier A Pagan

(74) *Attorney, Agent, or Firm* — Buche & Associates, P.C.; John K. Buche; Bryce A. Johnson

(57) ABSTRACT

Disclosed is a child-resistant case for storing vaporizer pen components, such as, cartridges, batteries, and chargers.

2 Claims, 27 Drawing Sheets

CHILD-RESISTANT CASE AND RELATED METHODS

CROSS-REFERENCE TO RELATED APPLICATIONS

This application is a continuation-in-part of U.S. patent application Ser. No. 16/734,281, filed Jan. 3, 2020, entitled Child Resistant Child-resistant Case and Related Methods, which is a continuation-in-part of U.S. Design patent application Ser. No. 29/717,611, filed Dec. 18, 2019, entitled Child-Resistant Container.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of child-resistant cases for carrying vape cartridges, chargers, and batteries for vaporizers.

Background of the Invention

With the increased sale and use of cannabis related products, there is an increased need for child-resistant containers and storage units for such products. As medicinal and recreational use of cannabis and cannabis related products increases, there are more requirements that these cannabis products be stored in child-resistant containers and packaging. One device for consuming cannabis related products that is becoming increasingly popular is a vaporizer pen, which is a portable device that heats up a vape cartridge to produce vapor. Commonly, vape cartridges contain cannabis oil. The vaporize pen is essentially comprised of a battery, which is used to power the heating element, a cartridge, and a charger. Since vape cartridges may contain cannabis oil and other parts, such as a battery or charger, may be a choking hazard, these products are not suitable for children and these items should be stored in a child-resistant case so that children cannot easily gain access to products that may be harmful if swallowed or consumed. Users may also want to store their vaporizer pen/vaporizer pen components discretely and conveniently.

Thus, a need exists for a child-resistant case that safely, discretely, and conveniently stores vaporizer pen components, including but not limited to, cartridges, batteries, and chargers. Moreover, some containers that store vaporizer pen components are crowded and hard to handle, accordingly, a need exists to allow a user to easily access vaporizer pen components when stored in a case.

SUMMARY OF THE INVENTION

In view of the foregoing, an object of this specification is to disclose a child-resistant vaporizer pen case.

It is another object of this specification to disclose a child-resistant vaporizer pen case that is easy to access for removal and storage of components.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally disclosed is a child-resistant case for vaporizer pen components, including, but not limited to, vape cartridges, batteries, and chargers. The details of a preferred embodiment of a case are described in connection with the figures.

Figure 1:
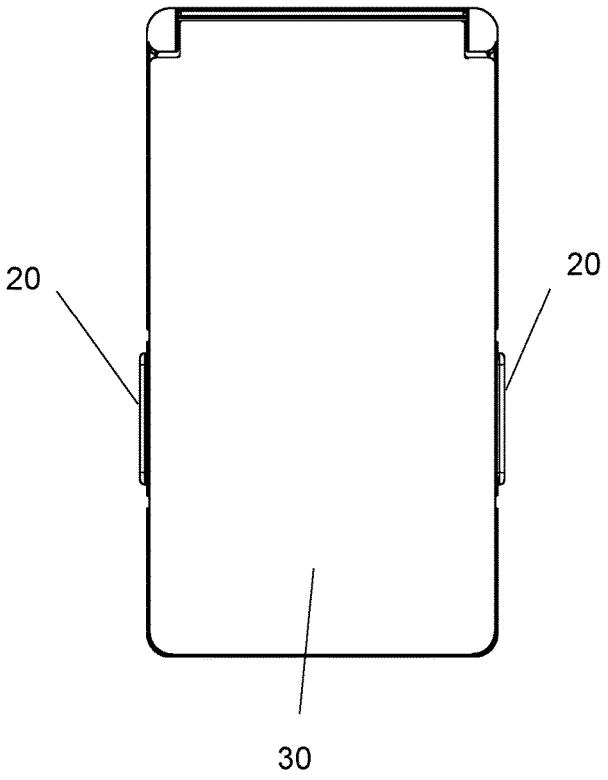
FIG. 1 is a front view of one embodiment of the child-resistant case in a closed configuration.
Figure 2:
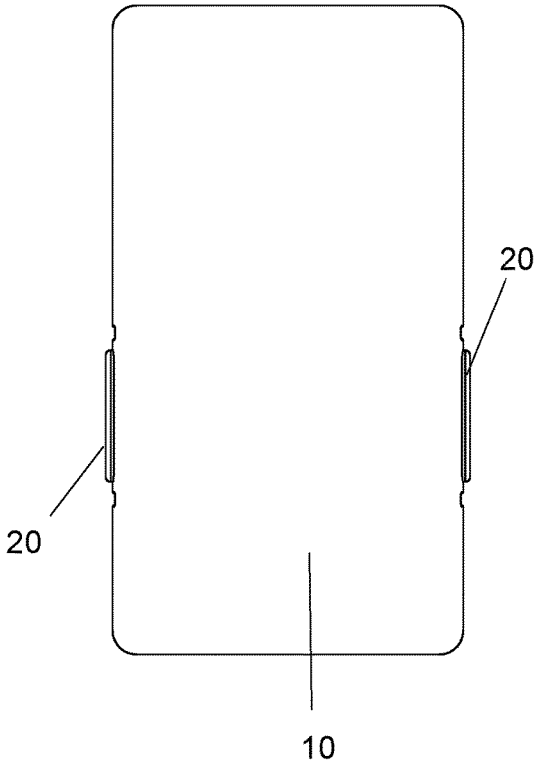
FIG. 2 is a back view of one embodiment of the child-resistant case in a closed configuration.
Figure 3:
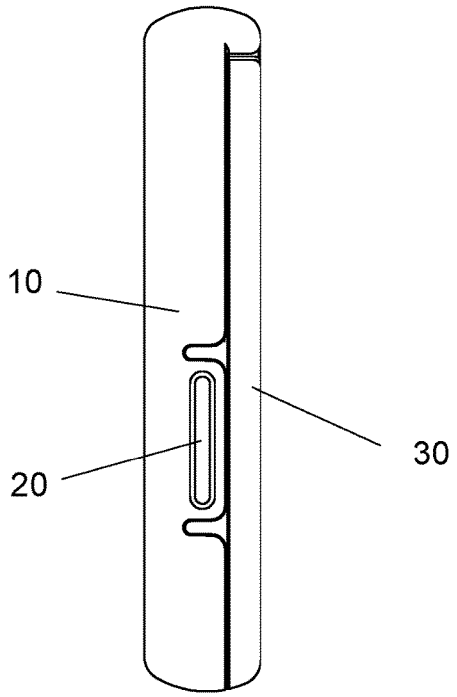
FIG. 3 is a left side view of one embodiment of the child-resistant case in a closed configuration.
Figure 4:
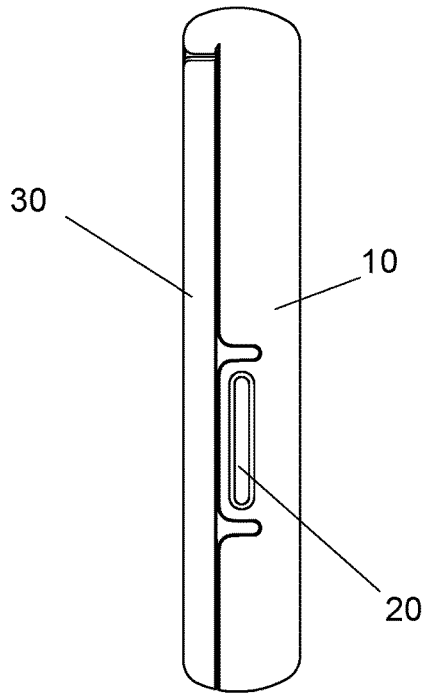
FIG. 4 is a right side view of one embodiment of the child-resistant case in a closed configuration.
Figure 5:
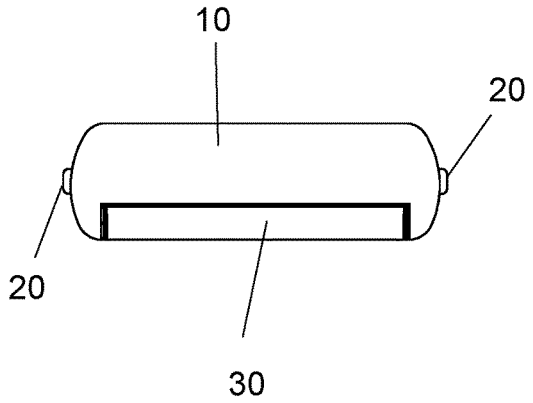
FIG. 5 is a top view of one embodiment of the child-resistant case in a closed configuration.
Figure 6:
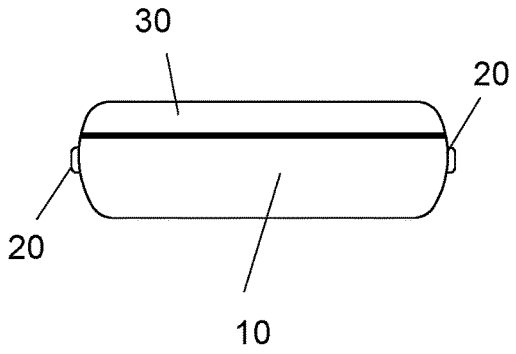
FIG. 6 is a bottom view of one embodiment of the child-resistant case in a closed configuration.
Figure 7:
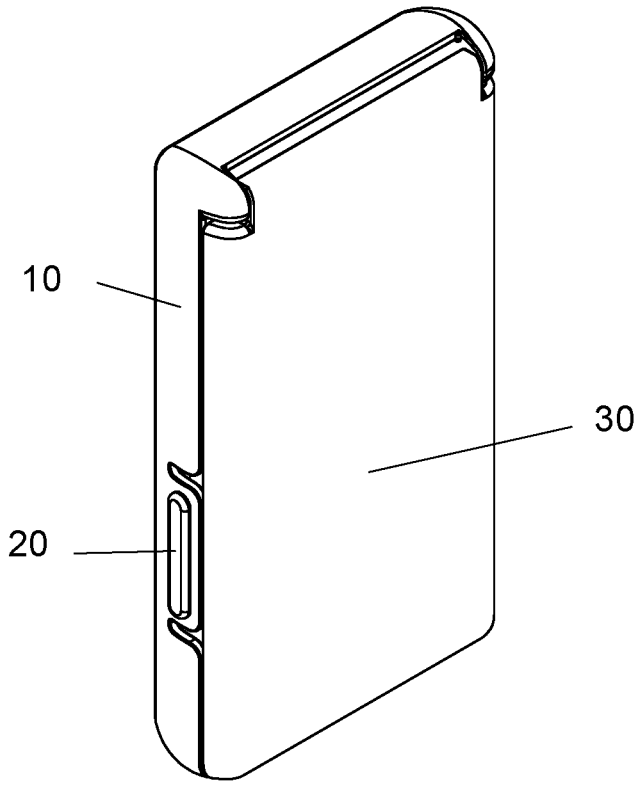
FIG. 7 is a perspective view of one embodiment of the child-resistant case in a closed configuration.
Figure 8:
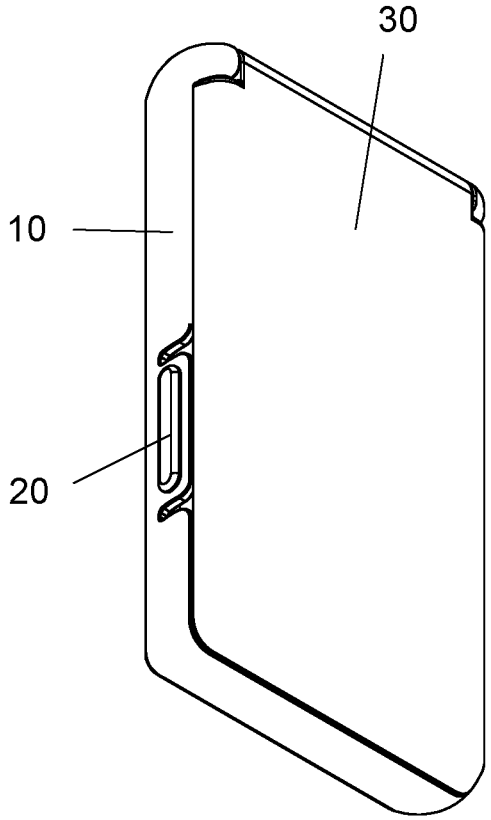
FIG. 8 is a perspective view of one embodiment of the child-resistant case in a closed configuration.

FIG. 1 is a front view of one embodiment of the child-resistant case in a closed configuration; FIG. 2 is a back view of one embodiment of the child-resistant case in a closed configuration; FIG. 3 is a left side view of one embodiment of the child-resistant case in a closed configuration; FIG. 4 is a right side view of one embodiment of the child-resistant case in a closed configuration; FIG. 5 is a top view of one embodiment of the child-resistant case in a closed configuration; FIG. 6 is a bottom view of one embodiment of the child-resistant case in a closed configuration; FIG. 7 is a perspective view of one embodiment of the child-resistant case in a closed configuration; and, FIG. 8 is a perspective view of one embodiment of the child-resistant case in a closed configuration.

Referring to FIGS. 1-8, when in a closed configuration, the child-resistant case is defined by a compartment 10, a first cover 30, and two releases 20, which protrude beyond each side of the first cover 30. The releases 20 are housed on the sides of the compartment 10 and are used to keep the first cover 30 securely closed when the child-resistant case is in a closed configuration. As discussed below, the releases 20 are a feature of child resistance to opening the case.

Figure 9:
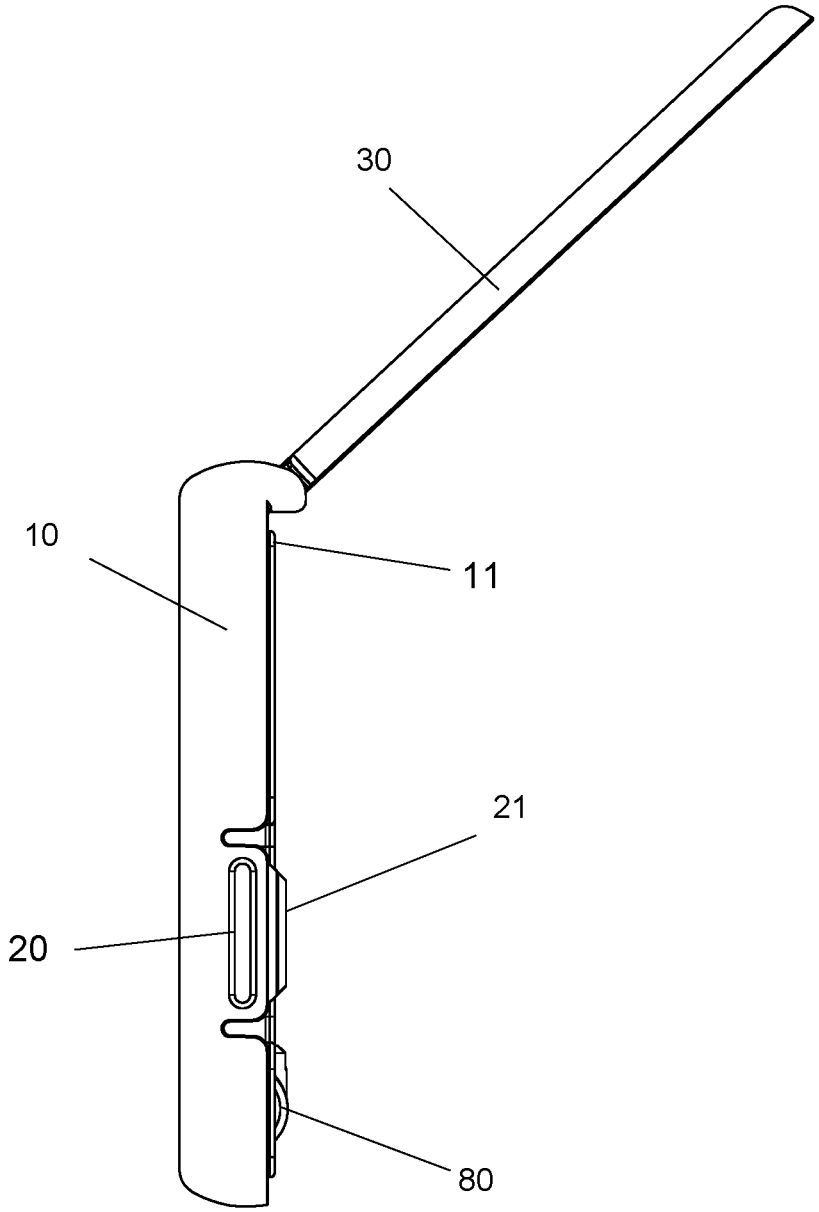
FIG. 9 is a side view of one embodiment of the child-resistant case in an open configuration.
Figure 10:
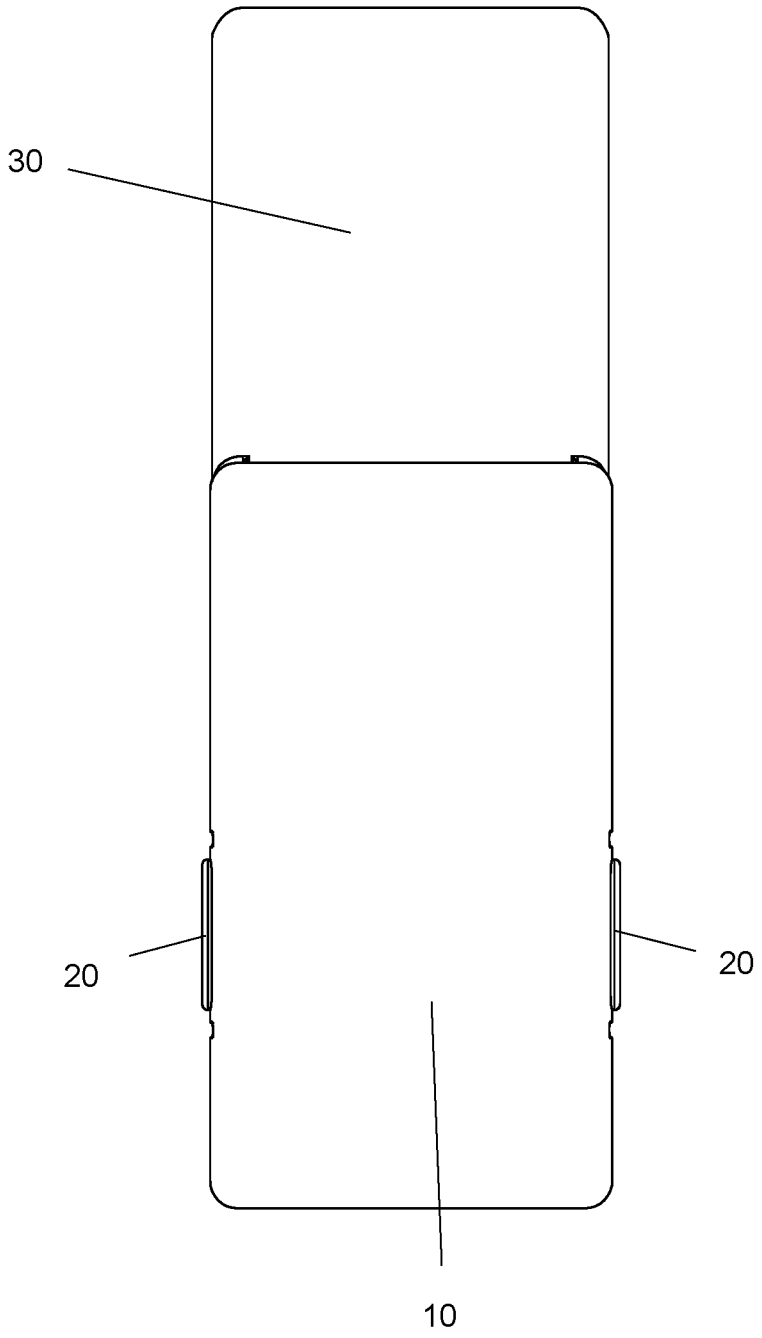
FIG. 10 is a back view of one embodiment of the child-resistant case in an open configuration.

FIG. 9 is a side view of one embodiment of the child-resistant case in an open configuration and FIG. 10 is a back view of one embodiment of the child-resistant case in an open configuration. Referring to FIG. 9, in a preferred embodiment, the child-resistant case is comprised of a compartment 10, a gasket 11, releases 20, tongues 21, a cover 30, grooves 31 (see FIG. 11), and a swiveling dock 80. In a preferred embodiment, the child-resistant case is defined by a compartment 10, which has a cover 30 that is pivotally or hingedly connected/affixed at the top of the compartment 10, wherein the cover 30 opens like a clamshell to reveal the compartment 10 as it rotates around the top of the of the compartment 10. Referring to FIG. 10, the compartment 10 has two releases 20 that protrude from each side of the compartment 10. Each release 20 interfaces with and controls a tongue 21 that engages with groove 31 in the cover 30 when the cover 30 is closed to form a snap-fit connection (see FIG. 11).

Figure 11:
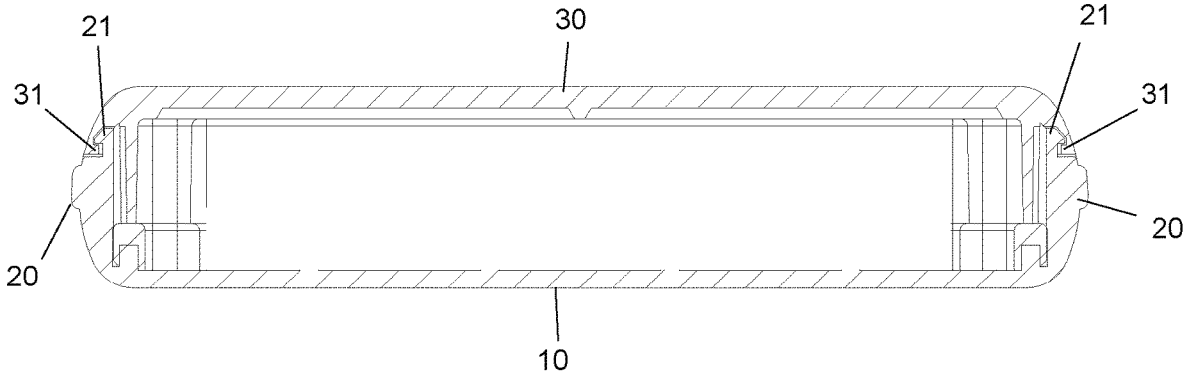
FIG. 11 is a cross-sectional view of one embodiment of the child-resistant case in a closed configuration.
Figure 11:
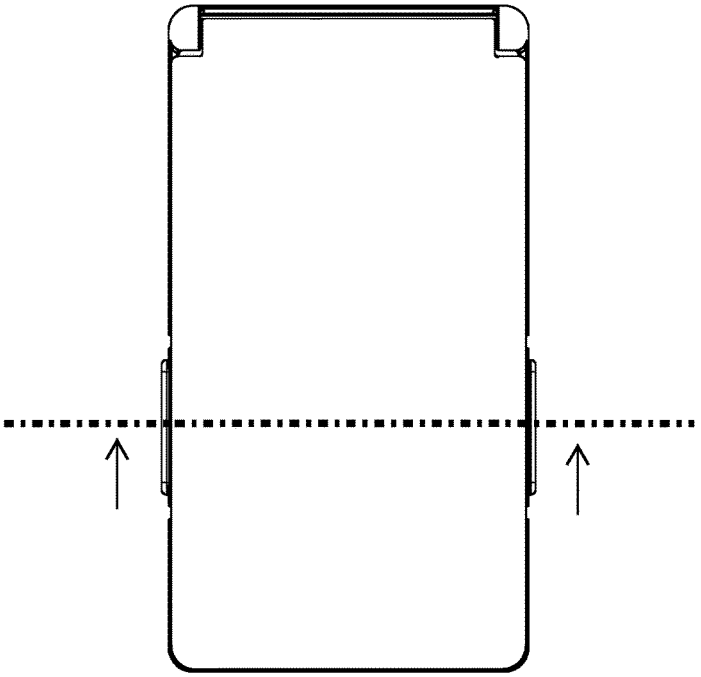
Figure 12:
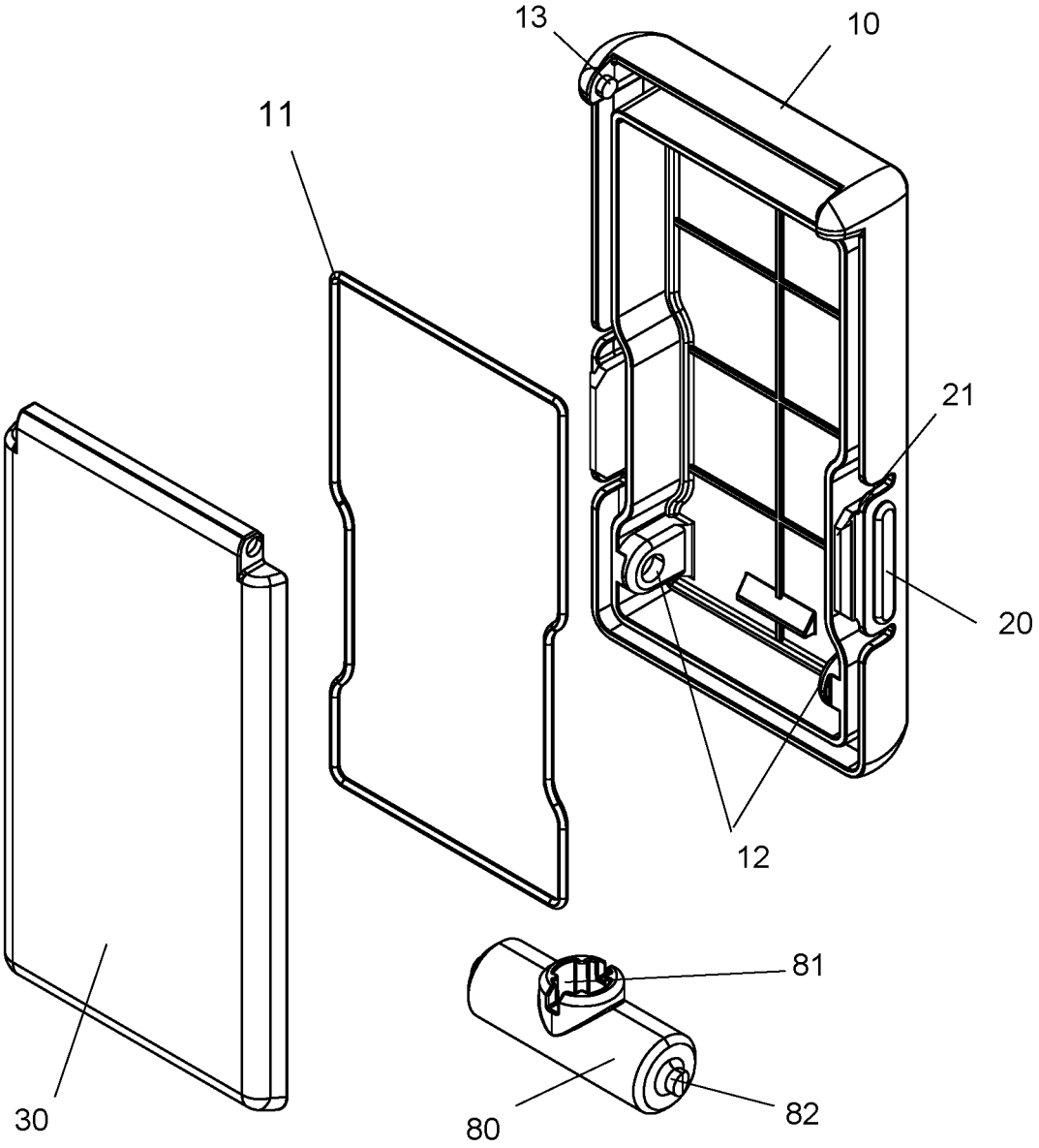
FIG. 12 is an exploded view of one embodiment of the first compartment of the child-resistant case.

FIG. 11 is a cross-sectional view of one embodiment of the child-resistant case in a closed configuration; FIG. 12 is an exploded view of one embodiment of the child-resistant case. Referring to FIG. 11, the compartment 10 has a release 20 located on each side of the compartment 10. Each release 20 controls a tongue 21, which is located above the release 20. Each tongue 21 engages with a groove 31 on the cover 30 to form a snap-fit connection and securely close the cover 30 over the compartment 10. When a user presses the release 20 inward, the tongue 21 moves inward and disengages from the groove 31, which allows the cover 30 to be lifted, and thereby opening the case. This action is difficult for a child to accomplish and, as a result, contributes to a child resistant operation.

Referring to FIGS. 9 and 12, in a preferred embodiment, the compartment 10 features a gasket 11 that is located around the perimeter of the compartment 10. The gasket 11 forms an air-tight seal that keeps odors inside of the compartment 10, when in a closed configuration. The gasket 11 also suitably forms a fluid-resistant seal that operates to keep moisture and other fluids out of the compartment 10, when in a closed configuration. The gasket 11 may be formed of a silicone or rubber material.

Still referring to FIG. 12, the compartment 10 may feature a first pivot 13 that is located at the top of the compartment and configured to receive and house the anchor of the top of the cover 30, whereby the cover 30 can pivot around the first pivot 13 to open and close the cover 30 over the compartment 10. The compartment 10 also features a dock pivot point 12, which receives the dock pivot anchor 82, whereby the dock 80 is securely housed within the compartment and swivels around the dock pivot point 12. In a preferred embodiment, the dock 80 features at least one port 81 that is configured to receive and hold a vape cartridge. In alternative embodiments, the dock 80 may hold multiple vape cartridges, batteries, and/or chargers. In a preferred embodiment, the port 81 is configured to house a 510 thread cartridge.

Figure 13:
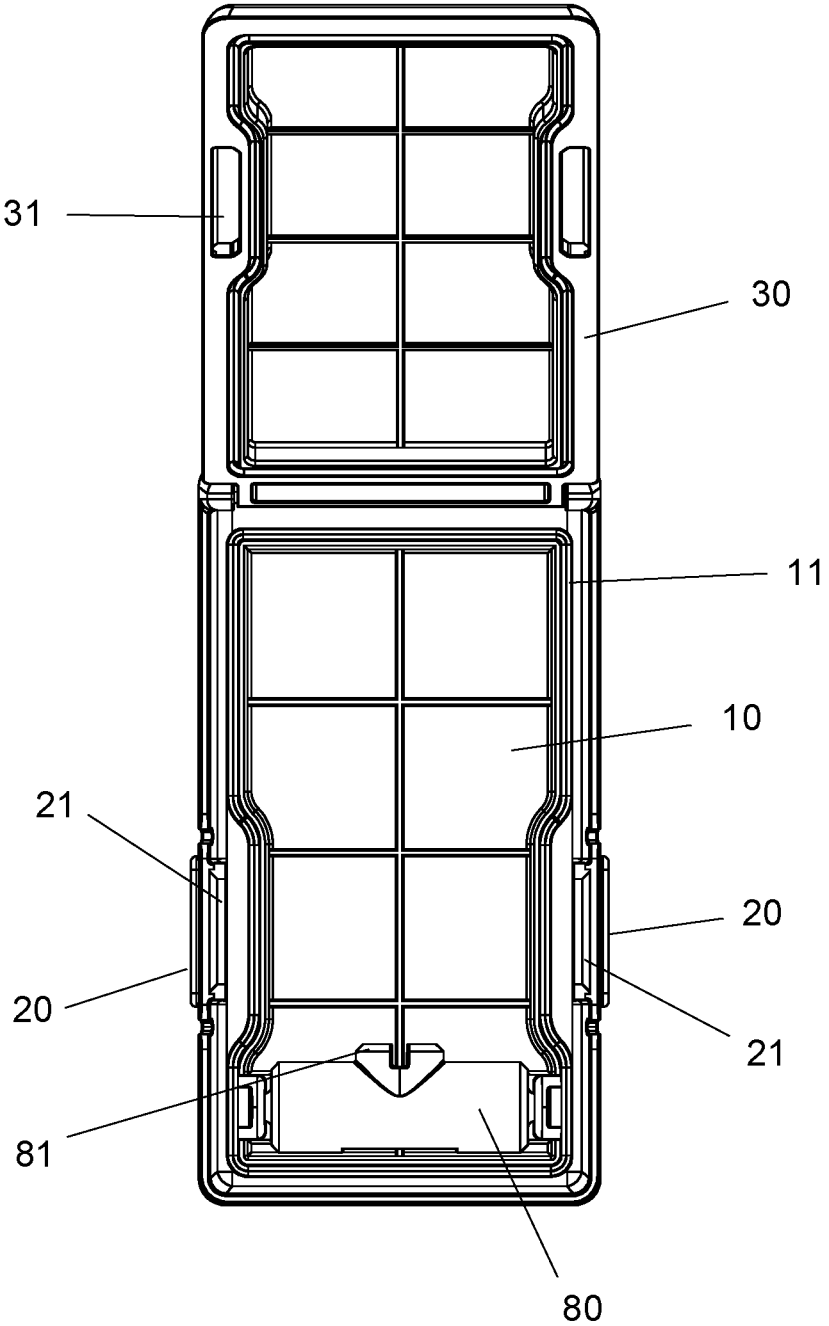
FIG. 13 is a front view of one embodiment of the child-resistant case in an open configuration.
Figure 14:
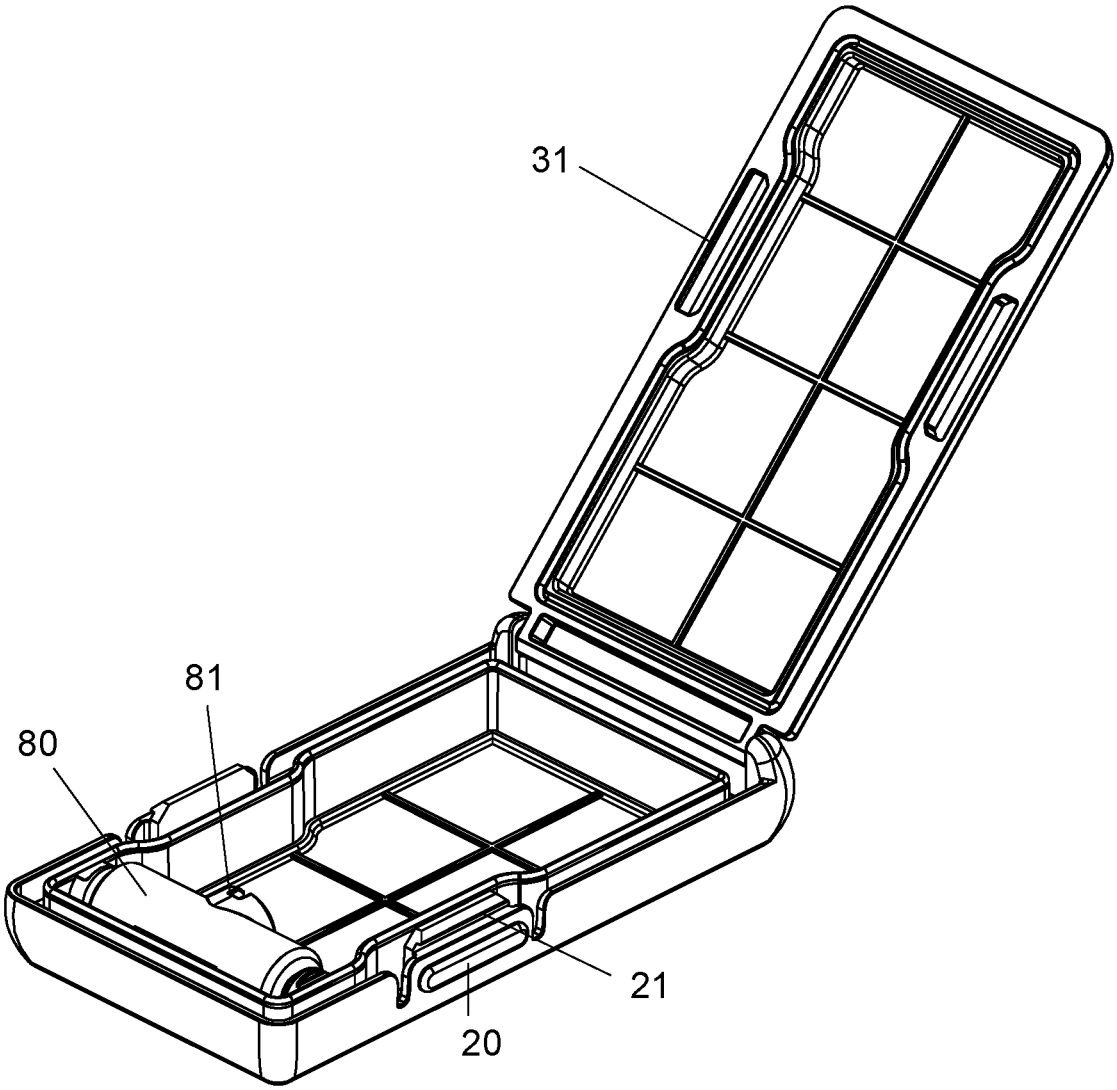
FIG. 14 is a perspective view of one embodiment of the child-resistant case in an open configuration.
Figure 15:
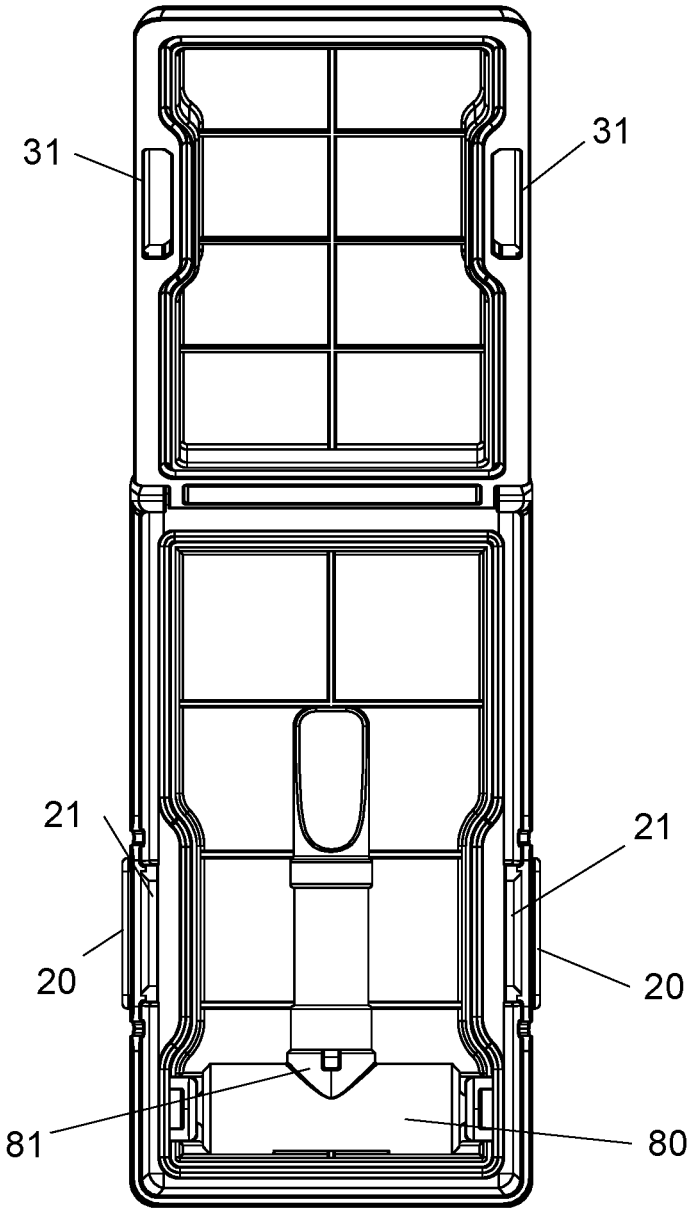
FIG. 15 is a front view of one embodiment of the child-resistant case in a loaded and open configuration.
Figure 16:
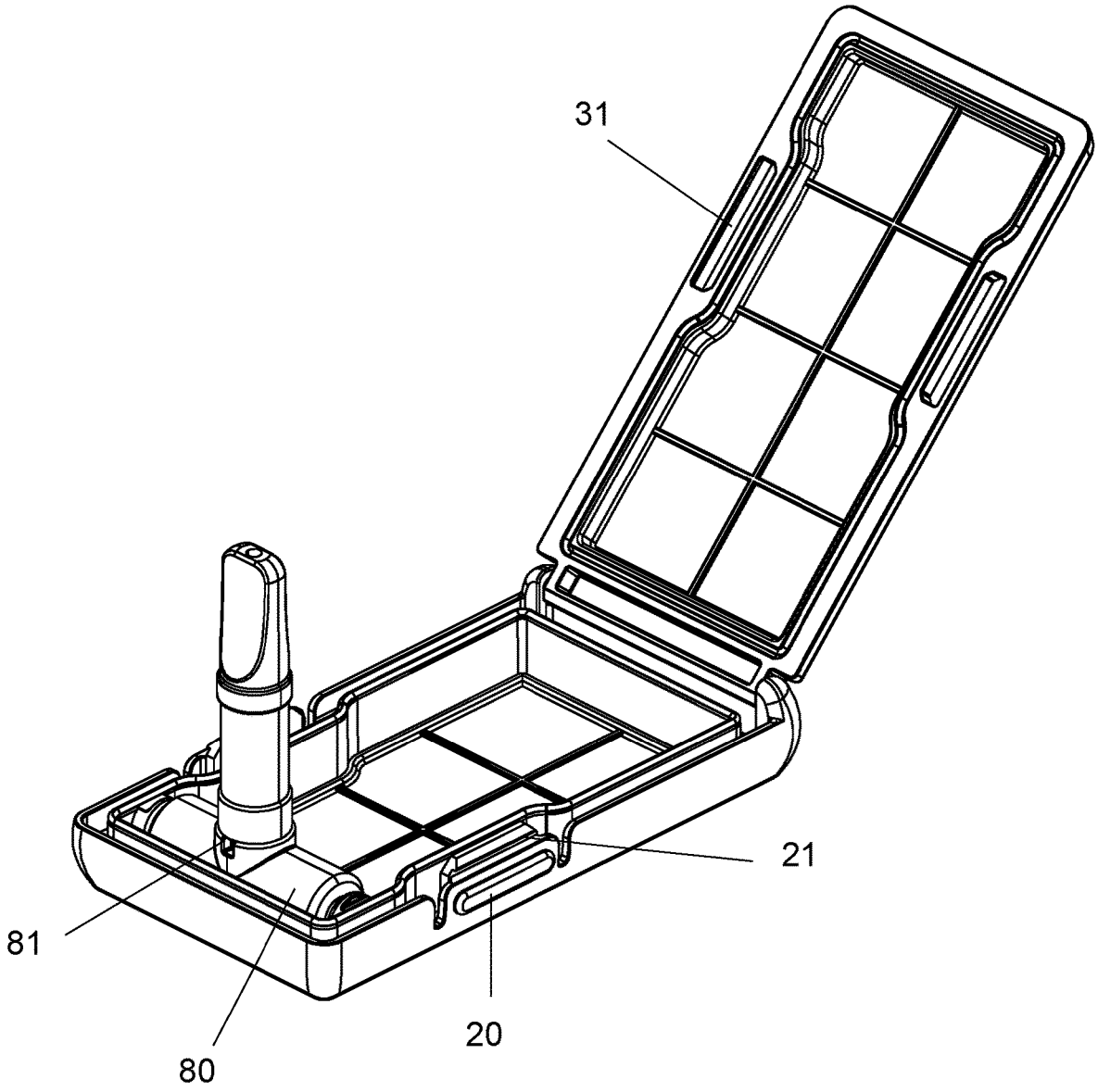
FIG. 16 is a perspective view of one embodiment of the child-resistant case in a loaded, pivoted, and open configuration.

FIG. 13 is a front view of one embodiment of the child-resistant case in an open configuration; FIG. 14 is a perspective view of one embodiment of the child-resistant case in an open configuration; FIG. 15 is a front view of one embodiment of the child-resistant case in a loaded and open configuration; and, FIG. 16 is a perspective view of one embodiment of the child-resistant case in a loaded, pivoted, and open configuration. FIGS. 15 and 16 are exemplary embodiments of the child-resistant case that stores one vape cartridge. Referring to FIGS. 15 and 16, the vape cartridge is inserted in to the port 81 of the dock 80. In a preferred embodiment, the dock 80 swivels within the compartment 10 to allow the user easy access to remove the cartridge from the port 81. That is, when the components are close to the compartment 10, it may be difficult to access the components, so the user can swivel the dock 80 and the stored components up and out of the compartment 10, wherein the components can be easily removed or inserted. In a preferred embodiment, the dock 80 may swivel 90 degrees within the compartment 10. A user may also display items in the port 81 by swiveling the dock 80 so that others can easily see what is being stored in the compartment 10.

Figure 17:
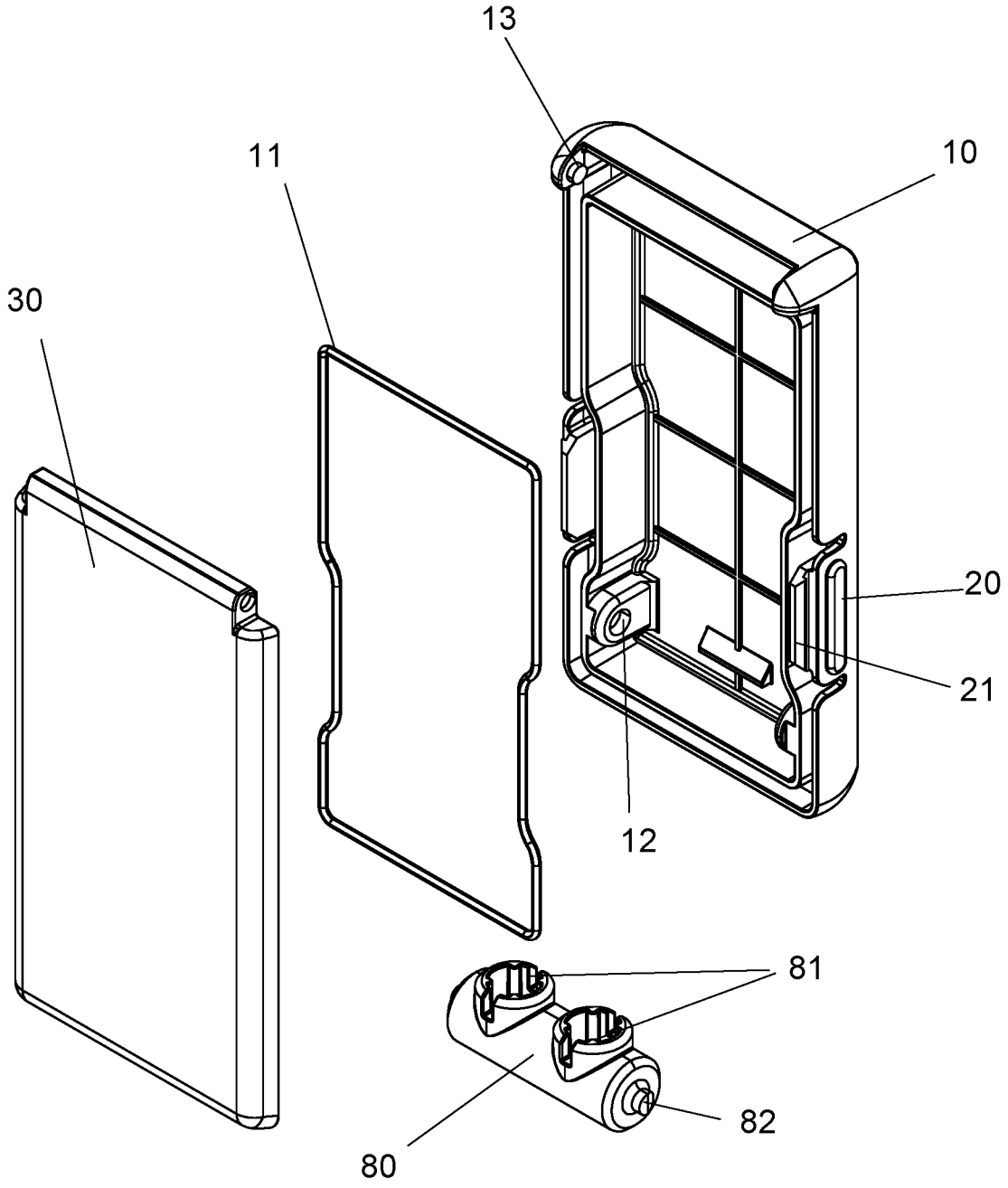
FIG. 17 is an exploded view of an alternative embodiment of the child-resistant case.
Figure 18:
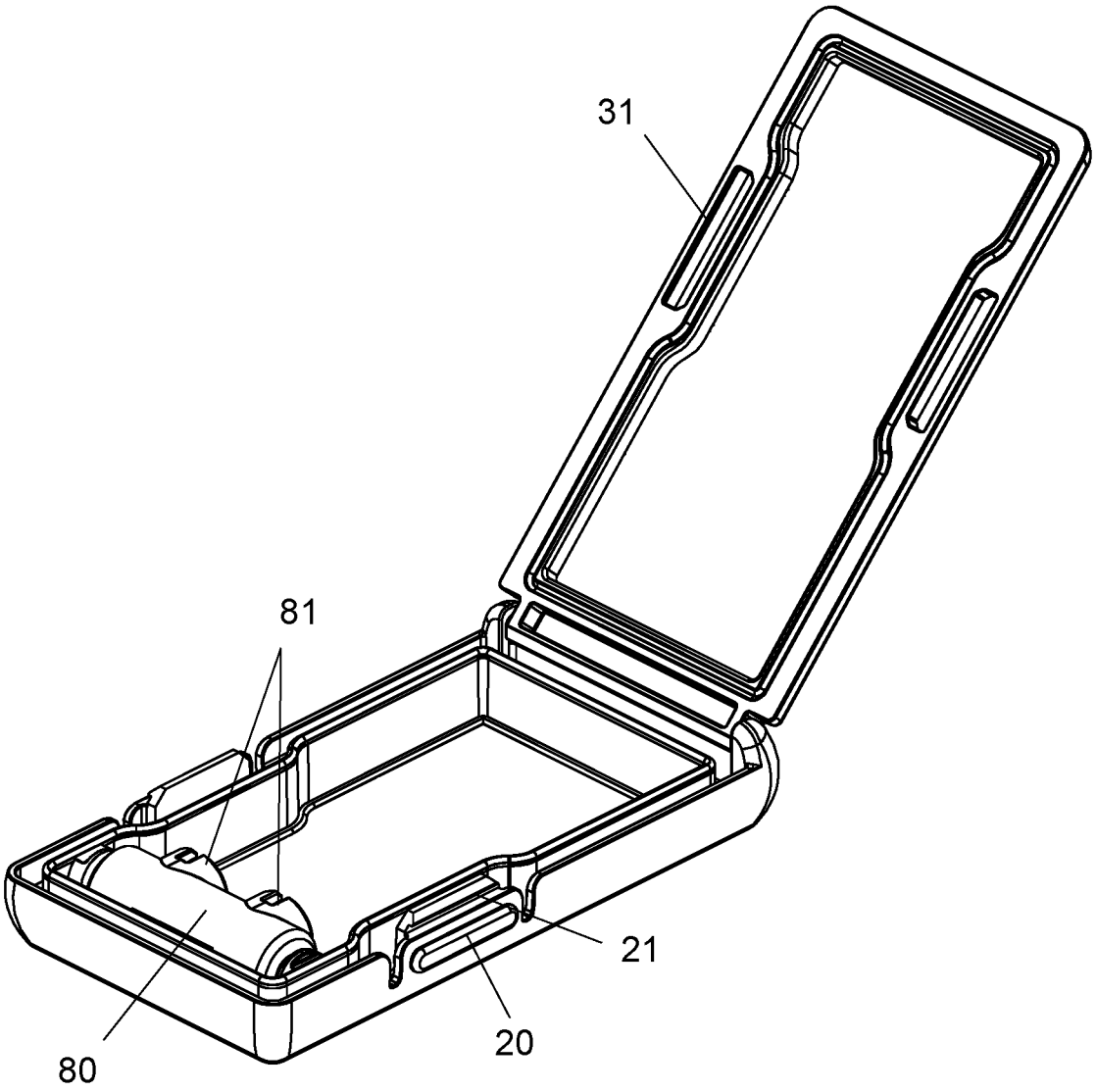
FIG. 18 is a perspective view of an alternative embodiment of the child-resistant case in an open configuration.
Figure 19:
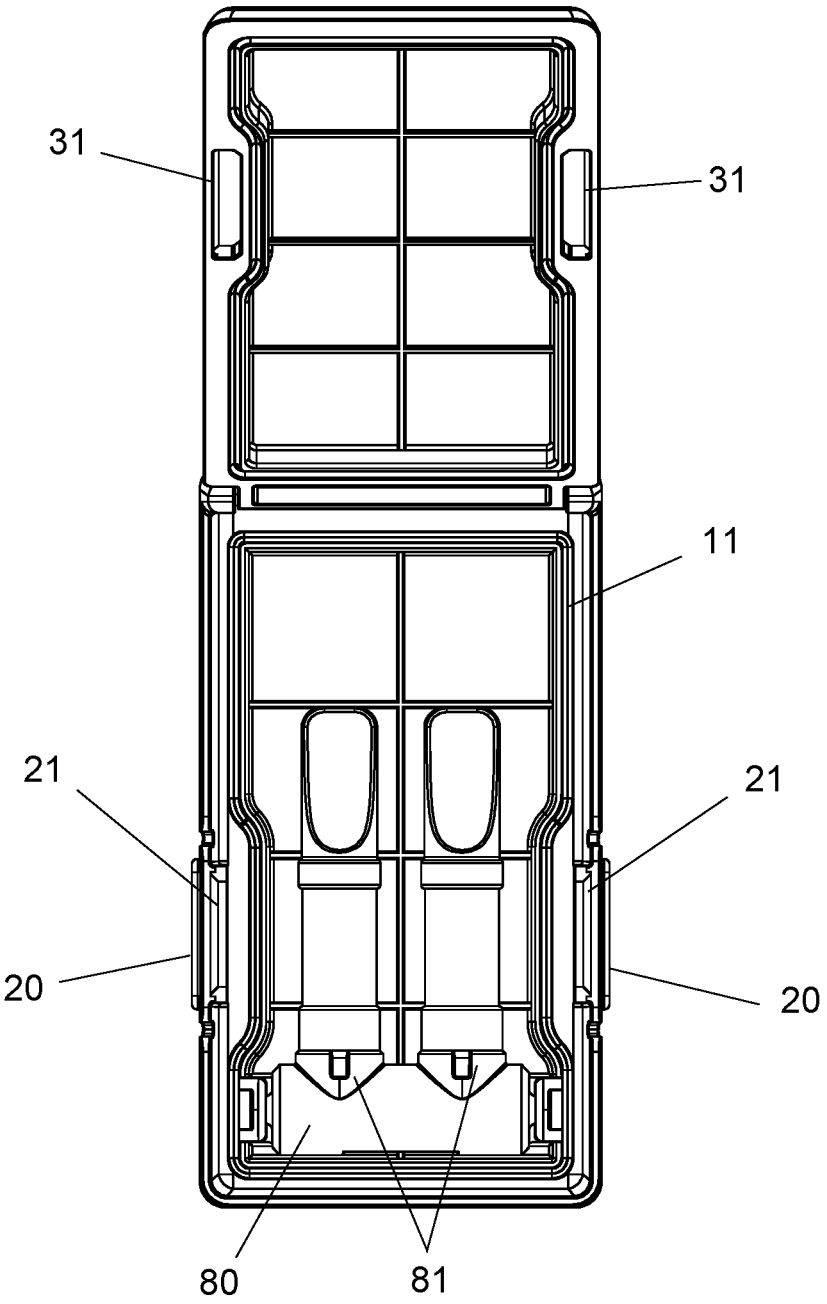
FIG. 19 is a front view of an alternative embodiment of the child-resistant case in a loaded and open configuration.

FIG. 17 is an exploded view of an alternative embodiment of the child-resistant case; FIG. 18 is a perspective view of an alternative embodiment of the child-resistant case in an open configuration; FIG. 19 is a front view of an alternative embodiment of the child-resistant case in a loaded and open configuration; and, FIG. 20 is a perspective view of an alternative embodiment of the child-resistant case in a loaded, pivoted, and open configuration.

Figure 20:
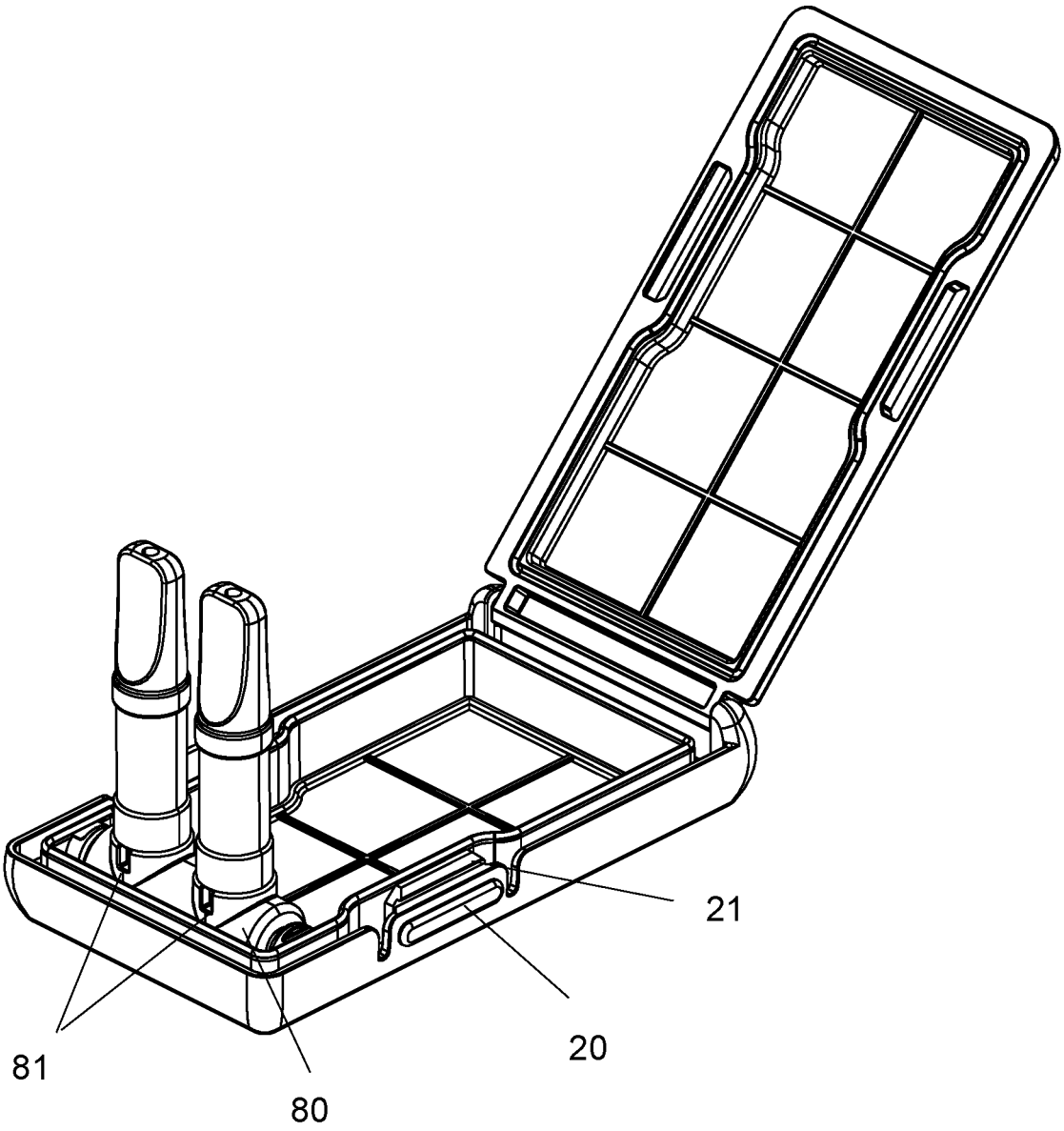
FIG. 20 is a perspective view of an alternative embodiment of the child-resistant case in a loaded, pivoted, and open configuration.

Referring to FIGS. 17-20, the dock 80 of the child-child resistant case may be configured to have two ports 81, wherein the dock 80 can house a combination of cartridges, batteries, and/or chargers. Referring to FIGS. 19-20, an exemplary embodiment of the child-resistant case stores two vape cartridges in the compartment 10. Referring to FIGS. 1-20, in one embodiment, the vape case may be approximately 50-60 mm wide, 15-20 mm in depth, and 100 mm in height.

Figure 21:
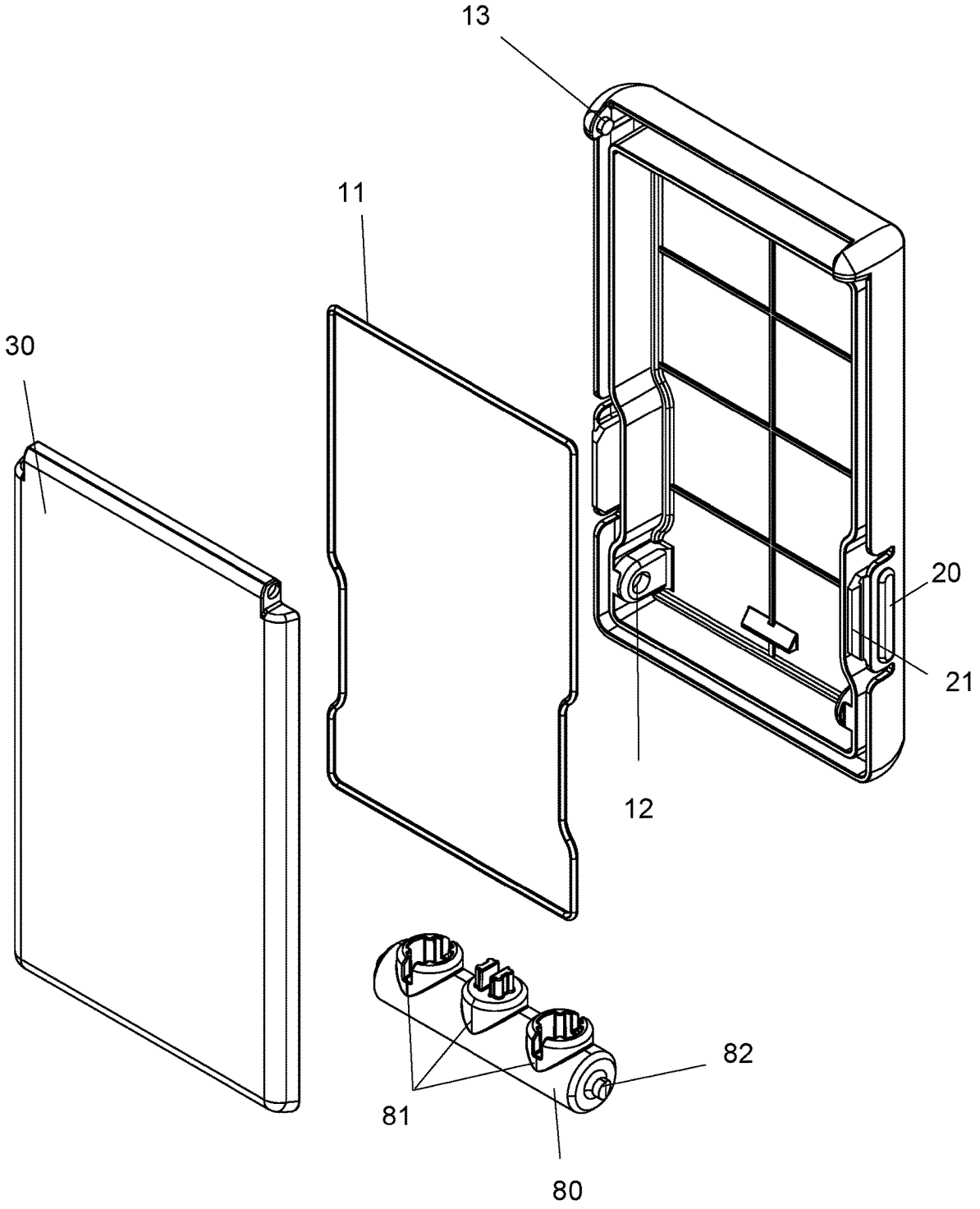
FIG. 21 is an exploded view of an alternative embodiment of the child-resistant case.
Figure 22:
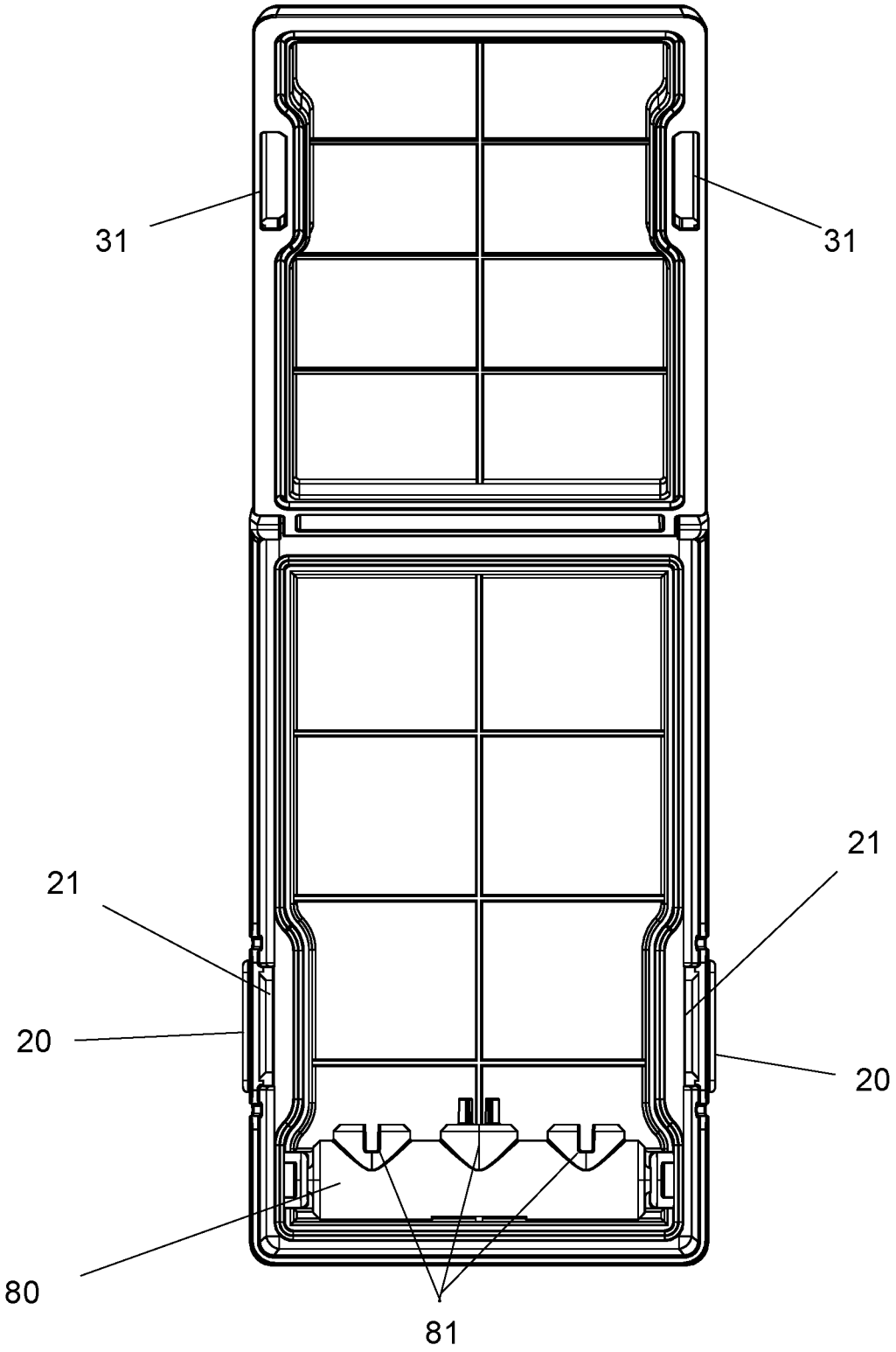
FIG. 22 is a front view of an alternative embodiment of the child-resistant case in an open configuration.
Figure 23:
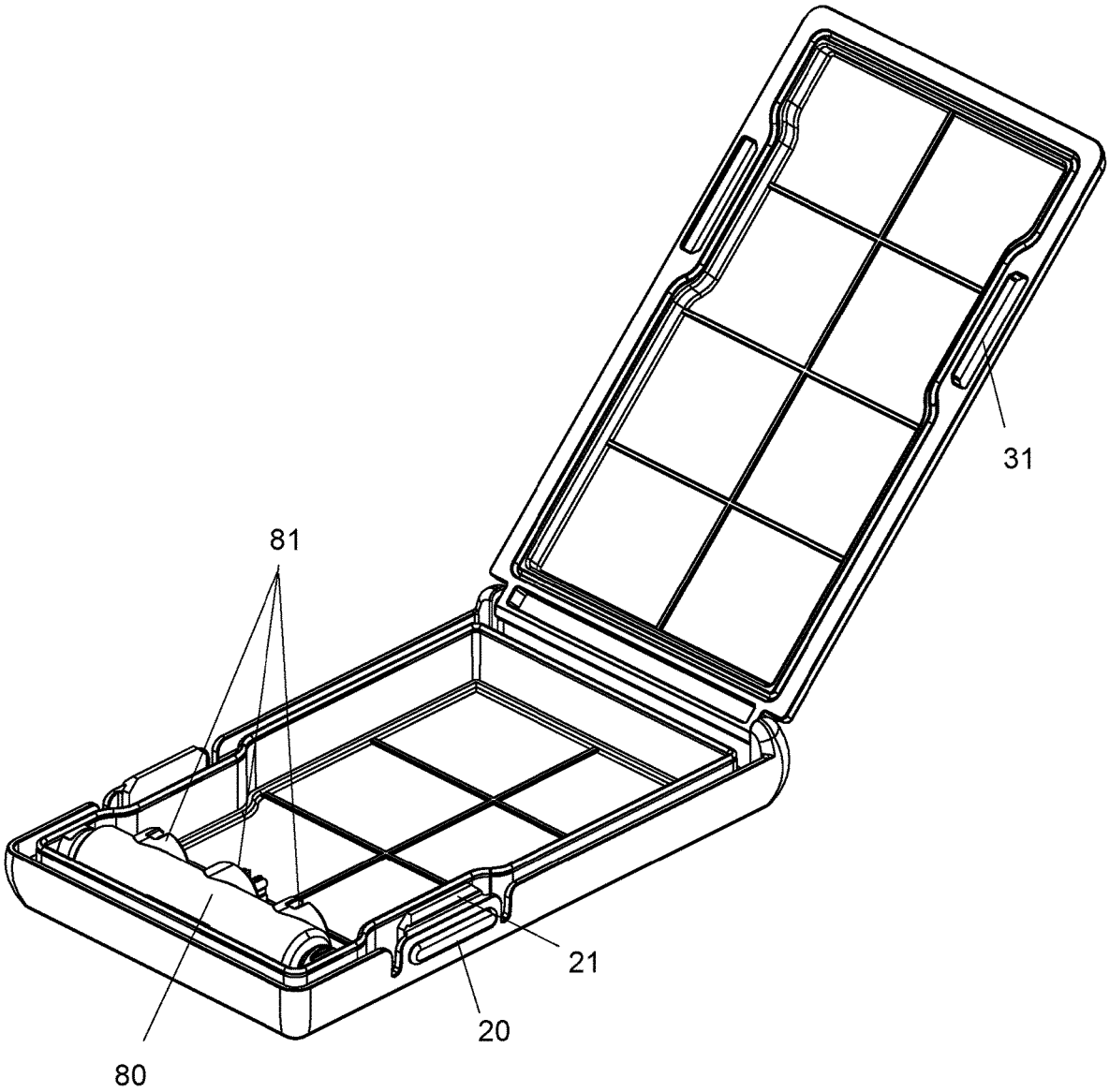
FIG. 23 is a perspective view of an alternative embodiment of the child-resistant case in an open configuration.

FIG. 21 is an exploded view of an alternative embodiment of the child-resistant case; FIG. 22 is a front view of an alternative embodiment of the child-resistant case in an open configuration; FIG. 23 is a perspective view of an alternative embodiment of the child-resistant case in an open configuration; and, FIG. 24 is a front view of an alternative embodiment of the child-resistant case in a loaded and open configuration; and, FIG. 25 is a perspective view of an alternative embodiment of the child-resistant case in a loaded, pivoted, and open configuration.

Figure 24:
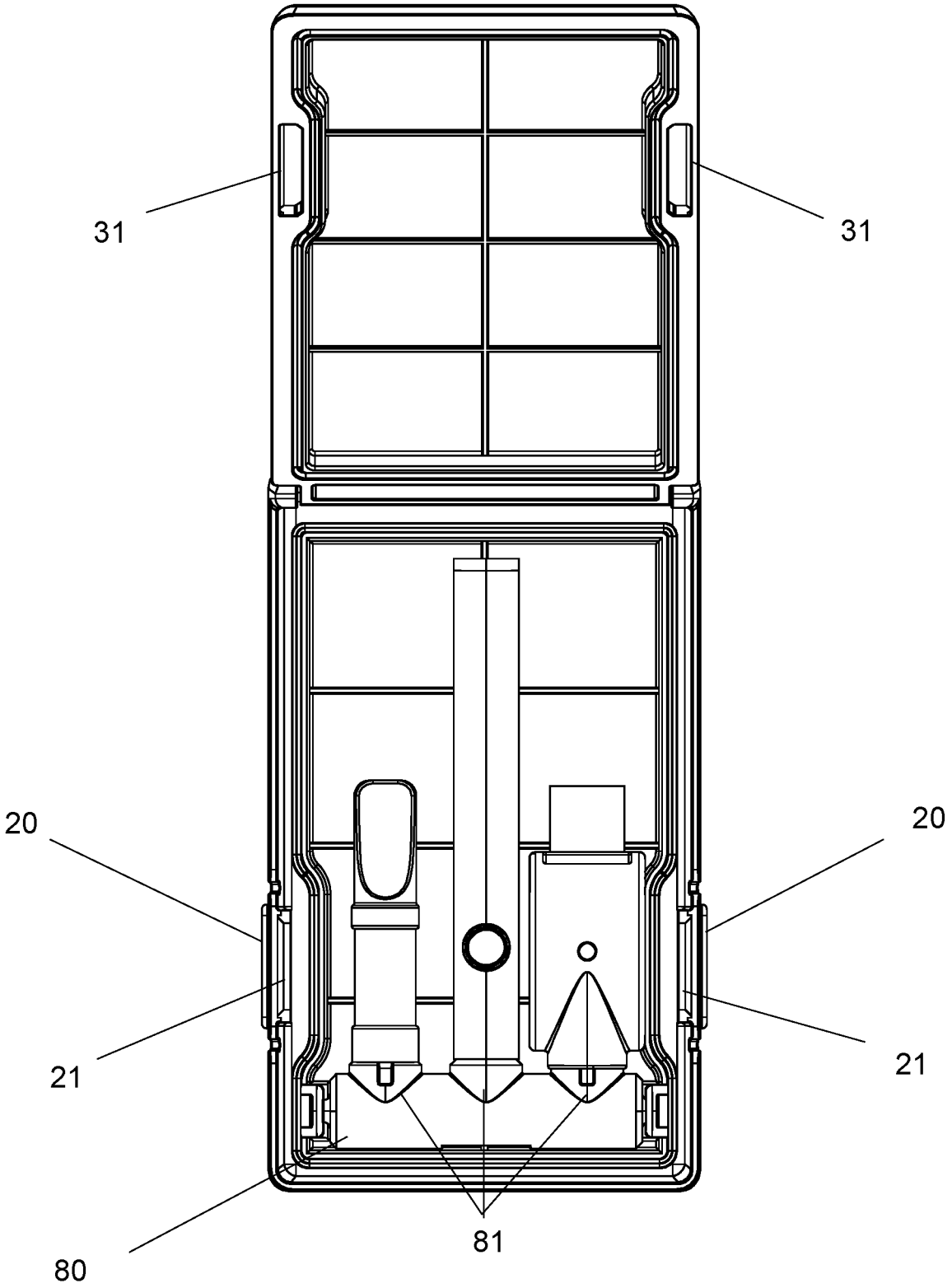
FIG. 24 is a front view of an alternative embodiment of the child-resistant case in a loaded and open configuration.
Figure 25:
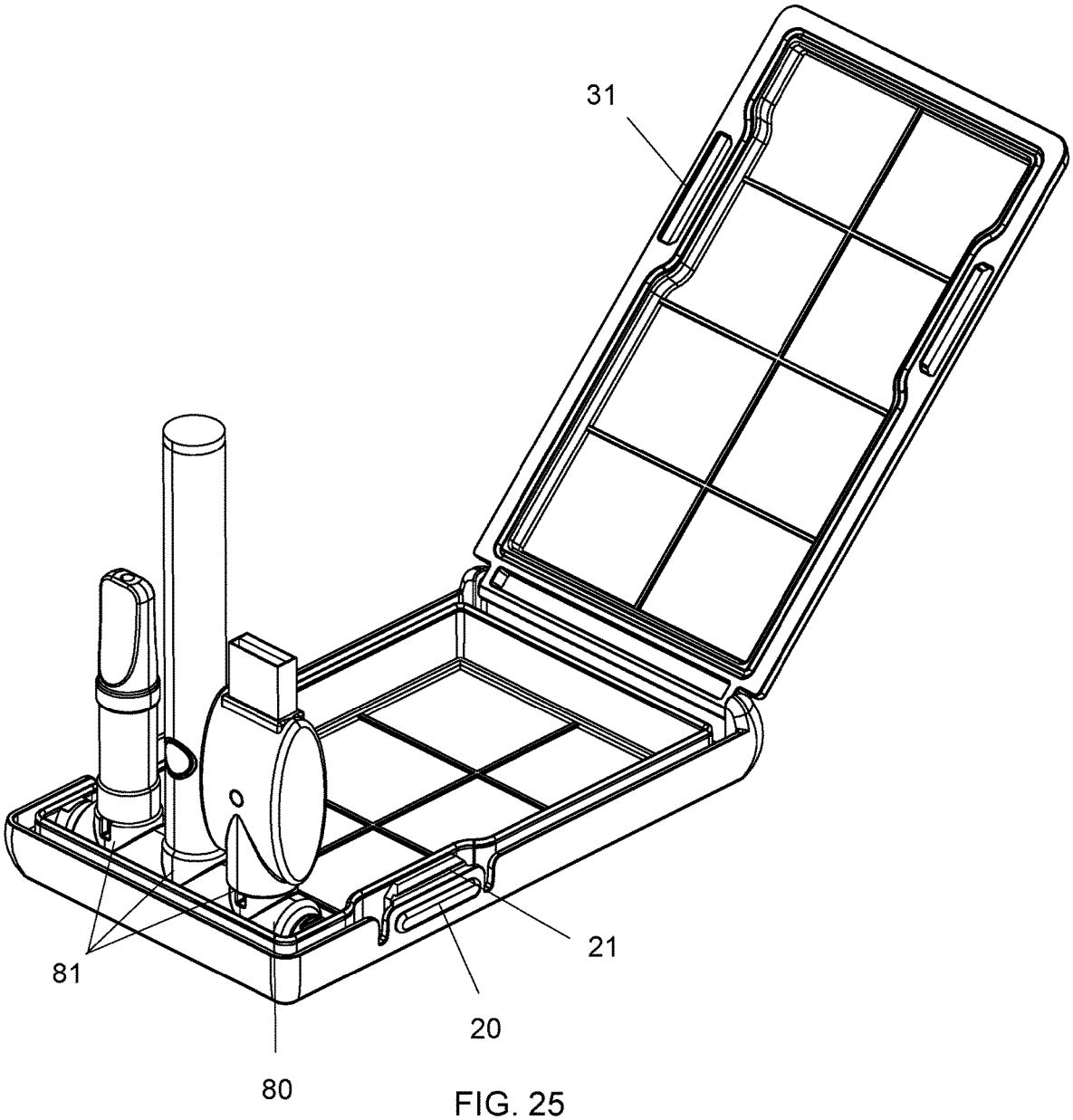
FIG. 25 is a perspective view of an alternative embodiment of the child-resistant case in a loaded, pivoted and open configuration.

Referring to FIGS. 21-25, the dock 80 may be configured to have three ports 81, wherein the dock 80 can house a combination of cartridges, batteries, and/or chargers. Referring to FIGS. 24-25, in an exemplary embodiment, the child-resistant case stores a cartridge, a battery, and a charger. In one embodiment, the vape case may be approximately 70-75 mm wide, 15-20 mm in depth, and 110-130 mm in height.

Figure 26:
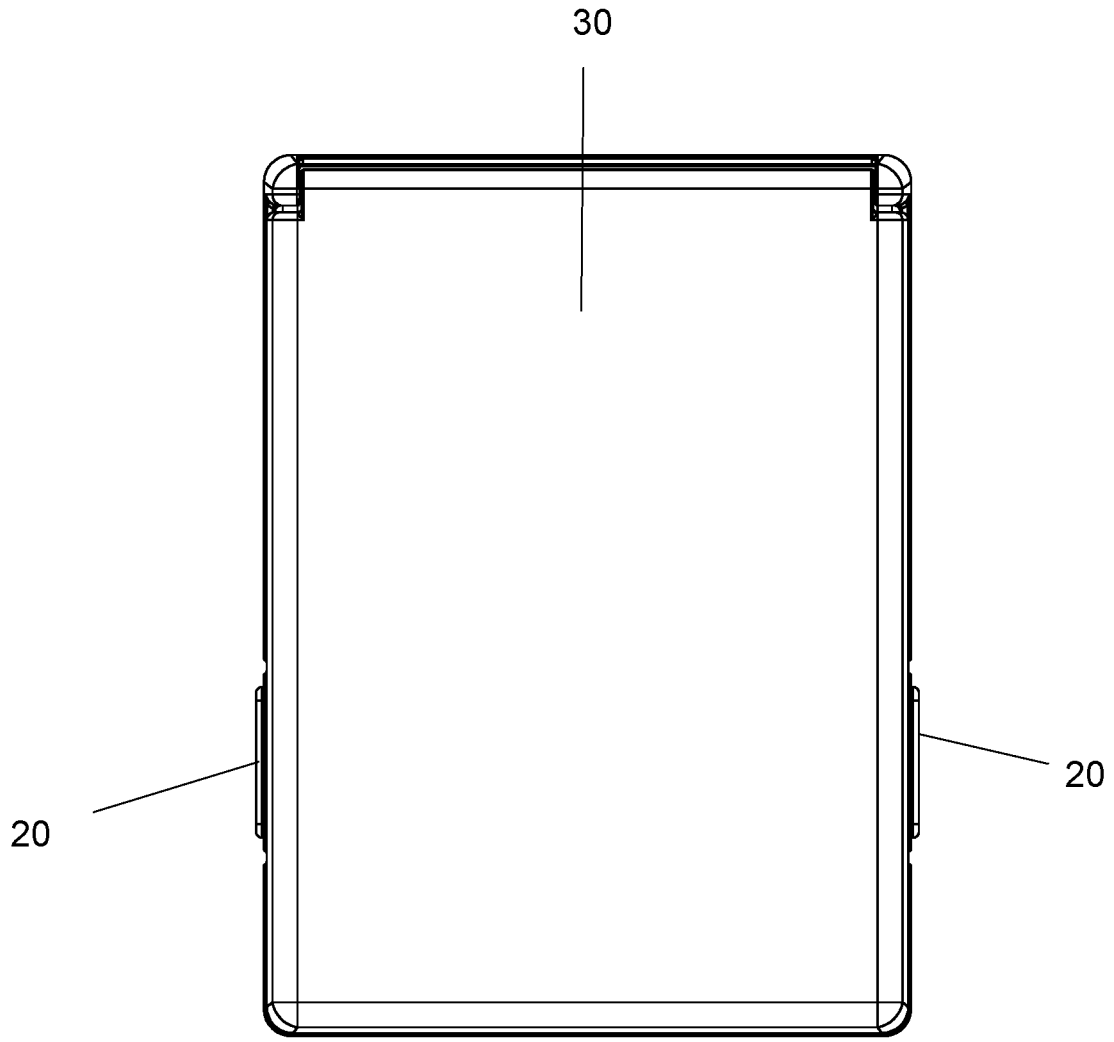
FIG. 26 is a front view of an alternative embodiment of the child-resistant case in a closed configuration.
Figure 27:
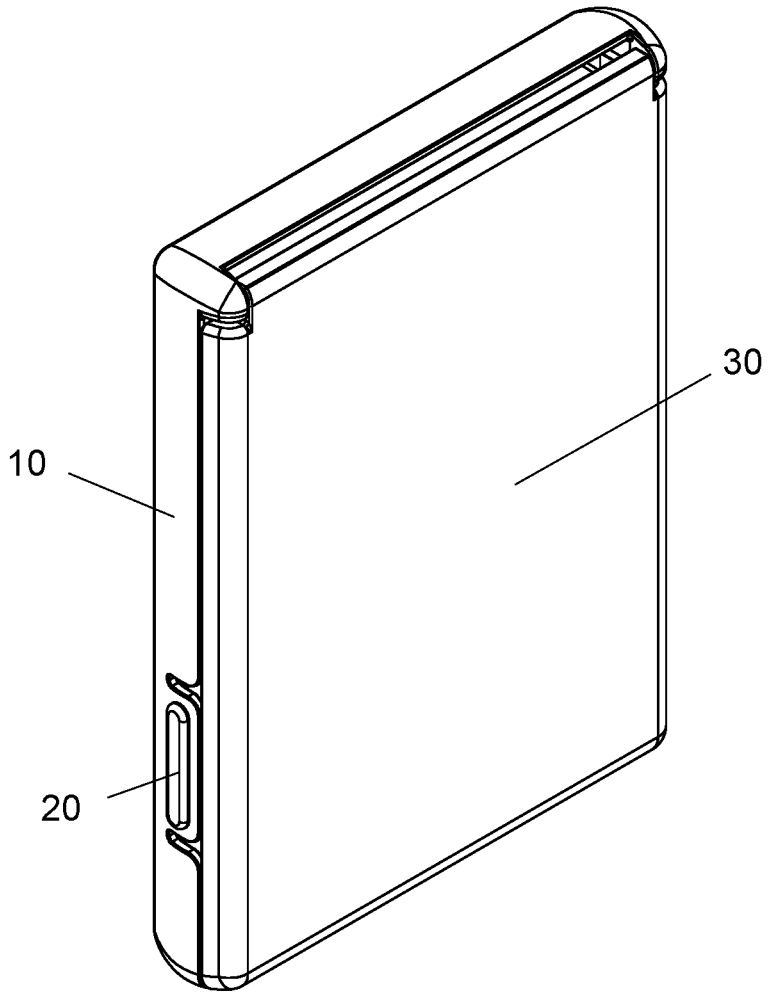
FIG. 27 is a perspective view of an alternative embodiment of the child-resistant case in a closed configuration.
Figure 28:
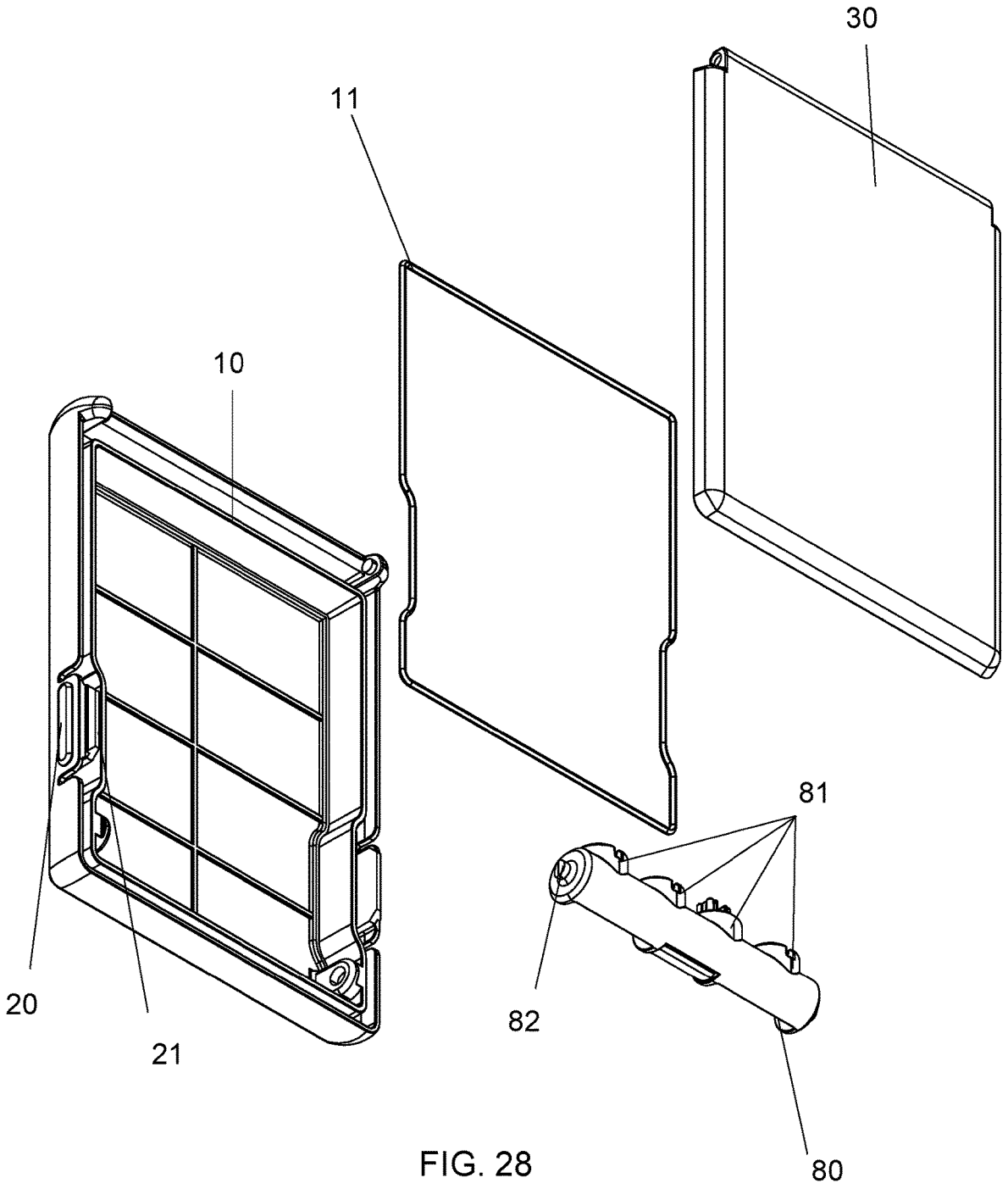
FIG. 28 is an exploded view of an alternative embodiment of the child-resistant case.
Figure 29:
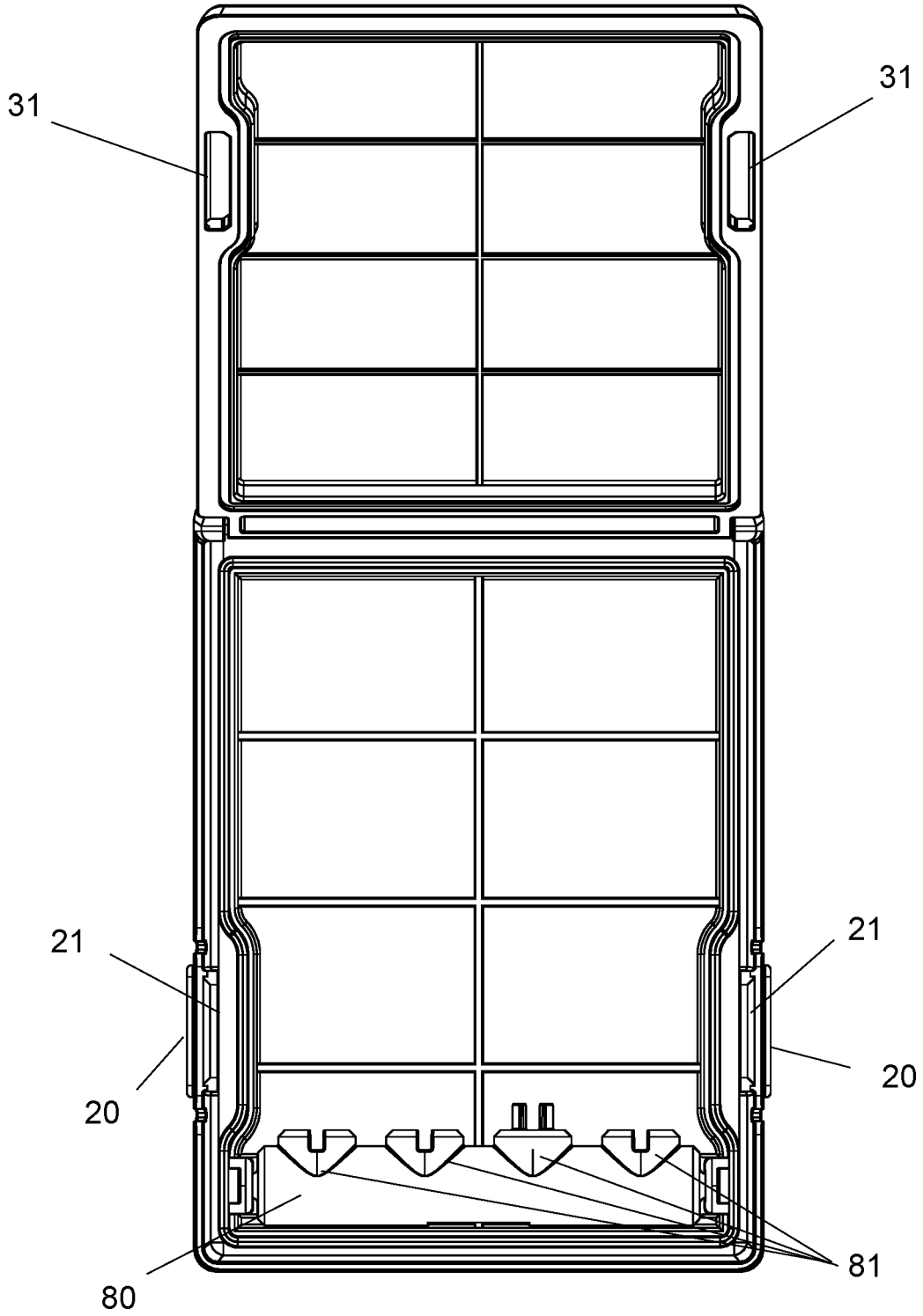
FIG. 29 is a front view of an alternative embodiment of the child-resistant case in an open configuration.
Figure 30:
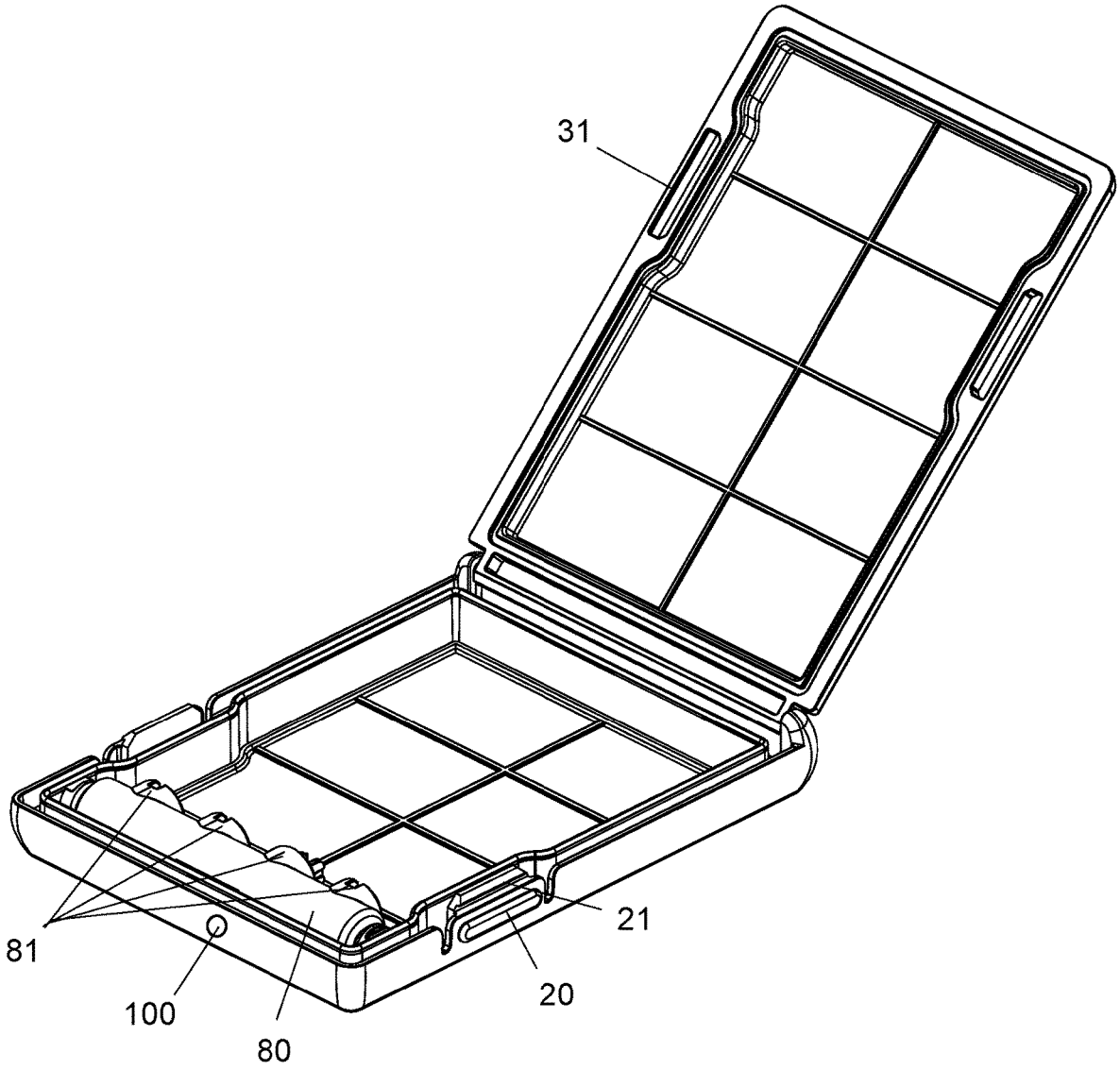
FIG. 30 is a perspective view of an alternative embodiment of the child-resistant case in an open configuration.
Figure 31:
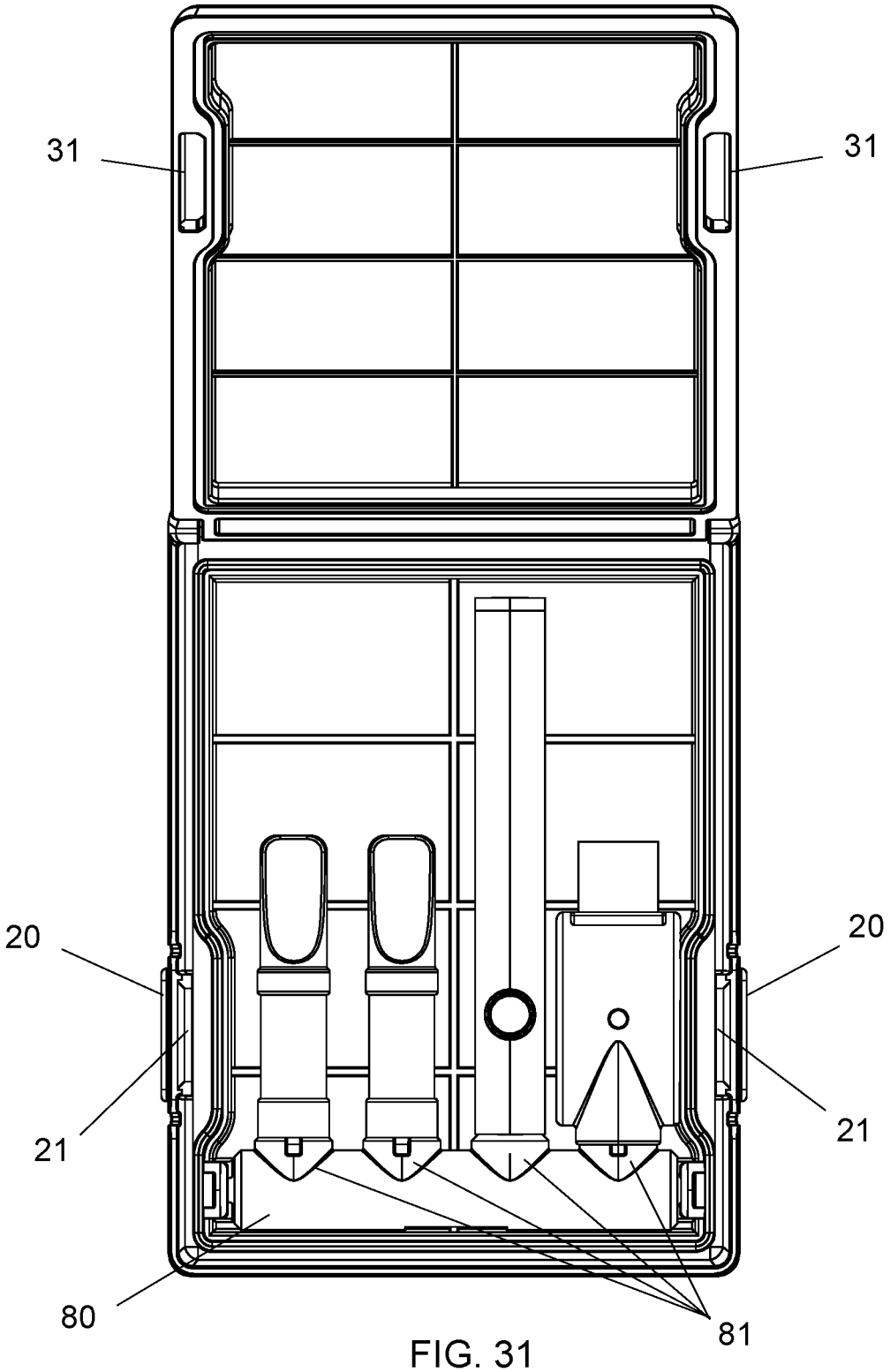
FIG. 31 is a perspective view of an alternative embodiment of the child-resistant case in a loaded and open configuration; and, FIG. 32 is a front view of an alternative embodiment of the child-resistant case in a loaded and open configuration.

FIG. 26 is a front view of an alternative embodiment of the child-resistant case in a closed configuration; FIG. 27 is a perspective view of an alternative embodiment of the child-resistant case in a closed configuration; FIG. 28 is an exploded view of an alternative embodiment of the child-resistant case; FIG. 29 is a front view of an alternative embodiment of the child-resistant case in an open configuration; FIG. 30 is a perspective view of an alternative embodiment of the child-resistant case in an open configuration; FIG. 31 is a perspective view of an alternative embodiment of the child-resistant case in a loaded and open configuration; and, FIG. 32 is a front view of an alternative embodiment of the child-resistant case in a loaded, pivoted, and open configuration.

Figure 32:
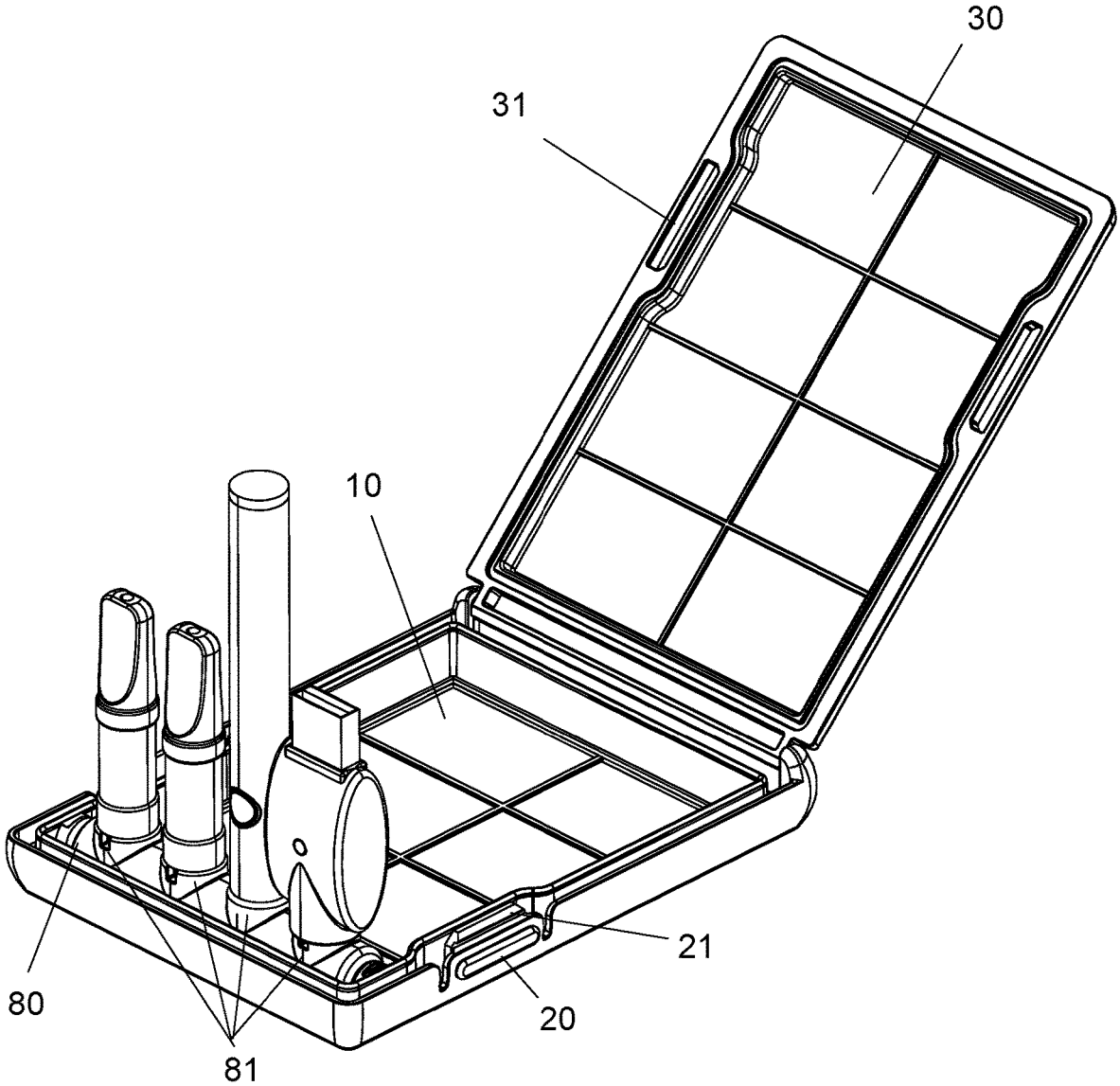

Referring to FIGS. 26-32, the child-resistant case may be configured to house four or more vaporizer pen components, wherein the compartment 10 and cover 30 are wide enough to house at least four vaporizer components. Referring to FIGS. 26-32, the dock 80 may be configured to have three ports 81, wherein the dock 80 can house a combination of cartridges, batteries, and/or chargers. Referring to FIG. 30, in an alternative embodiment, the child-resistant case may feature a battery in the dock 80, which can be recharged via a charging outlet 100. The battery in the dock 80 may be used as a portable charger to charge the vape pen battery when it is placed into the respective port 81. In a preferred embodiment, the charging outlet may be a female Universal Serial Bus (USB) connector, such as an A, B, Mini-A, Mini-B, Micro-A, or Micro-B USB connector. The battery in the dock 80 may be charged by connecting it to a power source via a male USB connector and the charging outlet 100. This battery in the dock 80 allows a user to portably charge the vape battery. In another embodiment, the battery in the dock 80 may be configured to charge wirelessly via a wireless charging station. Referring to FIGS. 31 and 32, in an exemplary embodiment, the child-resistant case stores two cartridges, a battery, and a charger. In one embodiment, the vape case may be approximately 80-90 mm wide, 15-20 mm in depth, and 110-130 mm in height.

In use, a user may store vaporizer pen components in a child-resistant case by: (i) obtaining a child-resistant case; (ii) placing a thumb or finger on one release 20 and another thumb or finger on the other release 20, wherein there is a thumb or finger on each release 20 on each side of the child-resistant case; (iii) simultaneously pressing the releases 20, wherein the releases 20 go inward and disengages the respective tongues 21 from the grooves 31 in the cover 30; (iv) lifting the cover 30 up to reveal the compartment 10; (v) inserting at least one vaporizer pen component (i.e., a vape cartridge, battery, and/or charger) into a port 81 on the dock 80; and, (vi) closing the cover 30 over the compartment 10 until the tongues 21 engage with the grooves 31, to form a secure child-resistant closure.

Referring to FIGS. 15-16, 19-20, 24-25, 31-32, in a preferred embodiment, the compartment 10 is configured to have a depth and length that is able to house a vape cartridge, battery, and/or charger.

In preferred embodiments, the ports 81 may be configured with male or female connectors to receive and store cartridges, batteries, and/or chargers (see FIGS. 22 and 29). In a preferred embodiment the child-resistant case may be composed of a rigid plastic or metal.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A method of storing a vaporizer pen component comprising:

obtaining a child-resistant case comprising a compartment (10) with a release (20) on at least one side of the compartment (10), wherein the compartment (10) further includes at least one tongue (21) that interfaces with each release (20), a cover (30), wherein the cover (30) is hingedly affixed to a top of the compartment (10), so that the cover (30) opens over the compartment (10) when the cover (30) is hingedly moved relative to the compartment (10), wherein the compartment (10) features a swiveling dock (80) that is swivelable within the compartment, wherein the swiveling dock (80) is provided with at least one port (81) that is disposed within the compartment (10), and, at least one groove (31) located on a left side and a right side of the cover (30), where each tongue (21) is provided into the at least one groove (31) to accomplish an engagement between the at least one tongue (21) when the cover (30) is securely closed over the compartment;

pressing the release inward so that the at least one tongue (21) is withdrawn from the at least one groove (31) and the engagement is disengaged;

lifting the cover (30) so that the cover (30) hingedly moves relative to the compartment (10);

swiveling the swiveling dock (80) so that the at least one port (81) is located outside of the compartment (10);

placing a vaporizer pen component in the at least one port (81);

swiveling the swiveling dock (80) so that the at least one port (81) and the vaporizer pen component are within the compartment (10); and, closing the cover (30) over the compartment (10) such that the at least one groove (31) on the cover (30) engages with the at least one tongue (21) on the compartment (10).

2. The method of claim 1, wherein a perimeter of the compartment (10) features a silicone gasket.

* * * * *